US009249643B2

(12) United States Patent
Melancon

(10) Patent No.: US 9,249,643 B2
(45) Date of Patent: Feb. 2, 2016

(54) BLOWOUT PREVENTER WITH WEDGE RAM ASSEMBLY AND METHOD OF USING SAME

(71) Applicant: National Oilwell Varco, L.P., Houston, TX (US)

(72) Inventor: Jeffrey Thomas Melancon, Willis, TX (US)

(73) Assignee: National Oilwell Varco, L.P., Houston, TX (US)

( * ) Notice: Subject to any disclaimer, the term of this patent is extended or adjusted under 35 U.S.C. 154(b) by 467 days.

(21) Appl. No.: 13/834,645

(22) Filed: Mar. 15, 2013

(65) Prior Publication Data

US 2014/0264099 A1 Sep. 18, 2014

(51) Int. Cl.
*E21B 33/06* (2006.01)

(52) U.S. Cl.
CPC ..... *E21B 33/063* (2013.01)

(58) Field of Classification Search
CPC ..... E21B 33/06; E21B 33/061; E21B 33/062; E21B 33/063; E21B 33/064
See application file for complete search history.

(56) References Cited

U.S. PATENT DOCUMENTS

| | | | | |
|---|---|---|---|---|
| RE19,047 | E | 1/1934 | Hinderliter | |
| 2,231,613 | A * | 2/1941 | Burke | E21B 33/062 251/1.3 |
| 3,235,224 | A | 2/1966 | Grove | |
| 3,684,008 | A | 8/1972 | Garrett | |
| 3,716,068 | A | 2/1973 | Addison | |
| 3,771,601 | A | 11/1973 | Garrett | |
| 4,132,266 | A | 1/1979 | Randall | |
| 4,132,267 | A | 1/1979 | Jones | |
| 4,162,057 | A | 7/1979 | Qasim | |
| 4,192,483 | A | 3/1980 | Combes | |
| 4,215,749 | A | 8/1980 | Dare et al. | |
| 4,332,367 | A | 6/1982 | Nelson | |
| 4,341,264 | A | 7/1982 | Cox et al. | |
| 4,508,313 | A | 4/1985 | Jones | |
| 4,523,639 | A | 6/1985 | Howard, Jr. | |
| 4,612,983 | A | 9/1986 | Karr, Jr. | |
| 4,646,825 | A | 3/1987 | Van Winkle | |

(Continued)

FOREIGN PATENT DOCUMENTS

| | | |
|---|---|---|
| GB | 2352494 | 4/2003 |
| WO | 03014604 | 2/2003 |

OTHER PUBLICATIONS

International Search Report for PCT Patent Application No. PCT/US2014/019636 dated Dec. 18, 2014, 2 pages.

*Primary Examiner* — Giovanna C Wright
(74) *Attorney, Agent, or Firm* — JL Salazar Law Firm

(57) ABSTRACT

A ram assembly of a blowout prevent (BOP) includes a ram shuttle, a ram wedge and a ram seat. The ram shuttle and the ram wedge are slidably positionable in a ram channel of a BOP housing between a retracted and extended position. The ram shuttle has a wedge cavity extending therethrough and an inclined surface thereon. The ram wedge has a tubular cavity therethrough for receiving the tubular. The ram wedge has a corresponding inclined surface engageable with the inclined surface of the ram shuttle, and wedges between the ram shuttle and the housing whereby a force is generated therebetween. The ram seat is positionable in the housing about the passage, and is engageable with the ram wedge and the housing when the ram shuttle and the ram wedge are moved to the extended position whereby a seal is formed therebetween.

21 Claims, 22 Drawing Sheets

(56) References Cited

U.S. PATENT DOCUMENTS

| | | | | |
|---|---|---|---|---|
| 4,671,312 | A | 6/1987 | Bruton | |
| 4,911,410 | A | 3/1990 | Baker | |
| 4,938,290 | A | 7/1990 | Leggett et al. | |
| 4,997,162 | A | 3/1991 | Baker et al. | |
| 5,199,493 | A | 4/1993 | Sodder, Jr. | |
| 5,360,061 | A | 11/1994 | Womble | |
| 5,400,857 | A | 3/1995 | Whitby et al. | |
| 5,501,424 | A | 3/1996 | Williams et al. | |
| 5,515,916 | A | 5/1996 | Haley | |
| 5,575,452 | A | 11/1996 | Whitby et al. | |
| 5,590,867 | A | 1/1997 | Van Winkle | |
| 5,775,420 | A | 7/1998 | Mitchell et al. | |
| 5,944,110 | A | 8/1999 | Watts et al. | |
| 6,145,594 | A * | 11/2000 | Jones | E21B 33/037 166/361 |
| 6,173,770 | B1 * | 1/2001 | Morrill | E21B 33/063 166/55 |
| 6,244,336 | B1 | 6/2001 | Kachich | |
| 6,454,015 | B1 | 9/2002 | Armstrong et al. | |
| 6,719,042 | B2 | 4/2004 | Johnson et al. | |
| 6,845,959 | B2 | 1/2005 | Berckenhoff et al. | |
| 7,011,159 | B2 | 3/2006 | Holland | |
| 7,086,467 | B2 | 8/2006 | Schlegelmilch et al. | |
| 7,207,382 | B2 | 4/2007 | Schaeper | |
| 7,225,873 | B2 | 6/2007 | Schlegelmiltch et al. | |
| 7,234,530 | B2 | 6/2007 | Gass | |
| 7,243,713 | B2 | 7/2007 | Isaacks et al. | |
| 7,410,003 | B2 | 8/2008 | Ravensbergen et al. | |
| 7,464,765 | B2 | 12/2008 | Isaacks et al. | |
| 7,721,808 | B2 | 5/2010 | Dallas et al. | |
| 7,975,761 | B2 | 7/2011 | Berckenhoff et al. | |
| 8,353,338 | B2 | 1/2013 | Edwards | |
| 8,567,490 | B2 * | 10/2013 | Van Winkle | E21B 33/063 166/85.4 |
| 2003/0029619 | A1 | 2/2003 | Sundararajan | |
| 2003/0132004 | A1 | 7/2003 | Suro | |
| 2005/0045846 | A1 | 3/2005 | Iwabuchi | |
| 2006/0144586 | A1 | 7/2006 | Urrutia | |
| 2007/0075288 | A1 | 4/2007 | Matte et al. | |
| 2007/0236006 | A1 | 10/2007 | Fultz et al. | |
| 2007/0246215 | A1 | 10/2007 | Springett et al. | |
| 2008/0135791 | A1 | 6/2008 | Juda et al. | |
| 2013/0270466 | A1 * | 10/2013 | Edwards | E21B 33/064 251/1.1 |
| 2014/0110611 | A1 * | 4/2014 | McClanahan | E21B 33/063 251/1.3 |

* cited by examiner

BLOWOUT PREVENTER WITH WEDGE RAM ASSEMBLY AND METHOD OF USING SAME

BACKGROUND

This present disclosure relates generally to techniques for performing wellsite operations. More specifically, the present disclosure relates to techniques for preventing blowouts involving, for example, sealing and/or severing a tubular of a wellbore.

Oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Downhole tubular devices may be positioned in the wellbore to enable the passage of subsurface fluids to the surface.

Leakage of subsurface fluids may pose an environmental threat if released from the wellbore. Equipment, such as blow out preventers (BOPs), may be positioned about the wellbore to form a seal about a tubular therein to prevent leakage of fluid as it is brought to the surface. BOPs may have selectively actuatable rams, such as pipe rams or shear rams, that may be activated to seal and/or sever a tubular in a wellbore. Some examples of BOPs are provided in U.S. Patent/Application No. 2010/0319906, U.S. Pat. Nos. 3,235,224, 4,215,749, 4,671,312, 4,997,162, 7,975,761, and 8,353,338. BOPs may be subject to forces, such as wellbore pressure and mechanical forces.

SUMMARY

In at least one aspect, the present disclosure relates to a ram assembly of a blowout preventer for sealing a wellbore. The blowout preventer has a housing with a passage therethrough for receiving a tubular of the wellbore and a ram channel therethrough. The ram assembly includes a ram shuttle, a ram wedge and a ram seat. The ram shuttle is slidably positionable in the ram channel between a retracted and extended position, and has a wedge cavity extending therethrough and an inclined surface thereon. The ram wedge has a tubular cavity therethrough for receiving the tubular, is slidably positionable in the wedge cavity between a retracted and an extended position, and has a corresponding inclined surface engageable with the inclined surface of the ram shuttle to wedge between the ram shuttle and the housing of the blowout preventer whereby a force is generated therebetween. The ram wedge is engageable with the tubular whereby the tubular is severed. The ram seat is positionable in the housing about the passage. The ram seat has a hole therethrough for receiving the tubular, and is engageable with the ram wedge and the housing of the blowout preventer when the ram shuttle and the ram wedge are moved to the extended position whereby a seal is formed therebetween.

In the extended position the ram wedge may form a fluid barrier between the channel and the ram seat. The ram assembly may also include a blade positionable on the ram wedge and engageable with the tubular whereby the tubular is severed. The ram shuttle may have a closed end or an open end. The ram shuttle and the ram wedge may move in the same direction or in opposite directions.

The tubular cavity may have a first portion and a second portion with a tapered shoulder therebetween, the first portion larger than the second portion. The wedge cavity may have a first portion for receiving a first portion of the ram wedge, and the wedge cavity may have a second portion for receiving the second portion of the ram wedge, the second portion of the ram wedge may be wider than the first portion of the ram wedge.

The ram shuttle and the ram wedge may have corresponding inclined surfaces for sliding engagement therebetween. The ram assembly may also include a piston and a cylinder operatively connectable to the ram shuttle and/or a piston and a cylinder operatively connectable to the ram wedge for driving movement thereof. The ram seat may be a metal to metal seal. The ram assembly may also include at least one additional seal.

In another aspect, the present disclosure relates to a blowout preventer for sealing the wellbore. The blowout preventer includes a housing having a passage therethrough for receiving the tubular and a ram channel therethrough, and at least one ram assembly. The ram assembly may include a ram shuttle, a ram wedge and a ram seat. The ram shuttle is slidably positionable in the ram channel between a retracted and extended position. The ram shuttle has a wedge cavity extending therethrough and an inclined surface thereon. The ram wedge has a tubular cavity therethrough for receiving the tubular, is slidably positionable in the wedge cavity between a retracted and an extended position, and has a corresponding inclined surface engageable with the inclined surface of the ram shuttle to wedge between the ram shuttle and the housing of the blowout preventer whereby a force is generated therebetween, the ram wedge engageable with the tubular whereby the tubular is severed. The ram seat may be positionable in the housing about the passage. The ram seat has a hole therethrough for receiving the tubular. The ram seat is engageable with the ram wedge and the housing of the blowout preventer when the ram shuttle and the ram wedge are moved to the extended position whereby a seal is formed therebetween. The blowout preventer may also include at least one controller.

Finally, in another aspect, the present disclosure relates to a method for sealing a wellbore. The wellbore has a tubular extending therefrom for passing therethrough. The method involves providing the blowout preventer, positioning a tubular through the passage, the tubular cavity and the hole, and forming a seal between the ram seat and the ram wedge by moving the ram shuttle and the ram wedge to the extended position.

The forming may involve moving the ram wedge and the ram shuttle together, moving the ram wedge to a partially engaged position and then moving the ram wedge to fully engaged position by moving the ram shuttle to the engaged position, forming a fluid barrier between the channel and fluid in the wellbore, and/or generating a force by wedging the ram wedge between the ram shuttle and the housing.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. It is to be noted, however, that the appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and/or instruction sequences that embody techniques of the present subject matter. However, it is understood that the described embodiments may be practiced without these specific details.

Tubulars are positioned in a wellbore for passing fluids from downhole reservoirs to the surface during wellbore production. A blowout preventer (BOP) may be provided about the wellbore for receiving the tubular. The BOP has at least one ram slidably movable in the BOP for severing and/or sealing the tubular during a blowout. The ram assembly is configured with a ram shuttle that slidingly engages a ram wedge during operation. The ram wedge wedgingly engages the ram shuttle within a channel of the BOP and generates a mechanical force therebetween. As the mechanical forces are applied, the ram wedge presses on a ram seat positioned in the BOP and forms a seal (e.g., a metal-metal-seal) therewith. The ram wedge and the ram seat form a fluid barrier between the channel housing the ram assembly and the passage in the BOP that leads to the wellbore.

"Blowout preventers" as used herein relate to devices, such as well control packages, valves, gate valves, ram driven assemblies or other severing, sealing or restriction devices of varying sizes used to sever a tubular in a wellbore and/or to seal a wellbore and prevent leakage of fluid therefrom.

"Tubulars, "tubular devices" or "tubular strings" as used herein relates to pipes, certain downhole tools, casings, drill pipe, liner, coiled tubing, production tubing, wireline, slickline, or other tubular members positioned in the wellbore, and associated components, such as drill collars, tool joints, drill bits, logging tools, packers, and the like.

Figure 1:
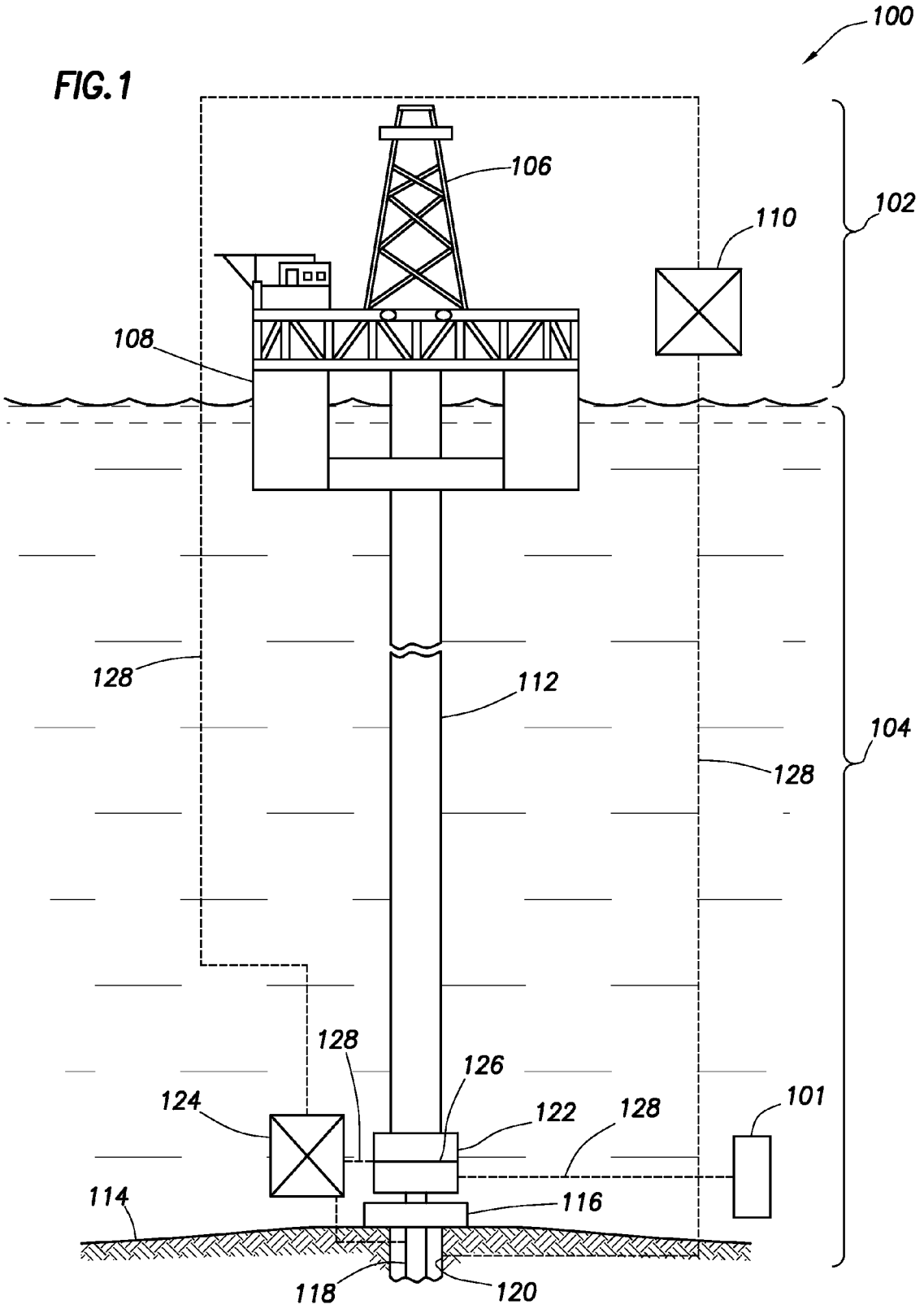
FIG. 1 depicts a schematic view of an offshore wellsite having a blowout preventer (BOP) with a wedge ram assembly.

FIG. 1 depicts an offshore wellsite 100 with a BOP monitoring system 101. While an offshore wellsite is depicted, the wellsite may be land based. The wellsite 100 has a surface system 102 and a subsea system 104. The surface system 102 may include a rig 106, a platform 108 (or vessel) and a surface unit 110. The surface unit 110 may include one or more units, tools, controllers, processors, databases, etc., located at the platform 108, a separate vessel, and/or near to or remote from the wellsite 100.

The subsea system 104 includes a conduit 112 extending from the platform 108 to a sea floor 114. The subsea system further includes a wellhead 116 with a tubular 118 extending into a wellbore 120, a BOP 122 and a subsea unit 124. As shown, the BOP 122 has a ram assembly 126 for shearing and/or sealing about the tubular 118 to seal the wellbore 120. One or more BOPs 122, ram assemblies 126 and associated equipment may be provided. The ram assembly 126 is a wedge ram assembly capable of generating a mechanical force for sealing as will be described further herein.

The surface system 102 and subsea system 104 may be provided with one or more units, such as surface unit 110 and/or subsea unit 124, located at various locations to control the surface system 102 and/or the subsea systems 104. Communication links 128 may be provided for communication between the units and various parts of the wellsite 100. The BOP monitoring unit 101 may monitor operation of the BOP and collect data therefrom. This data may be communicated to the units.

Figure 2:
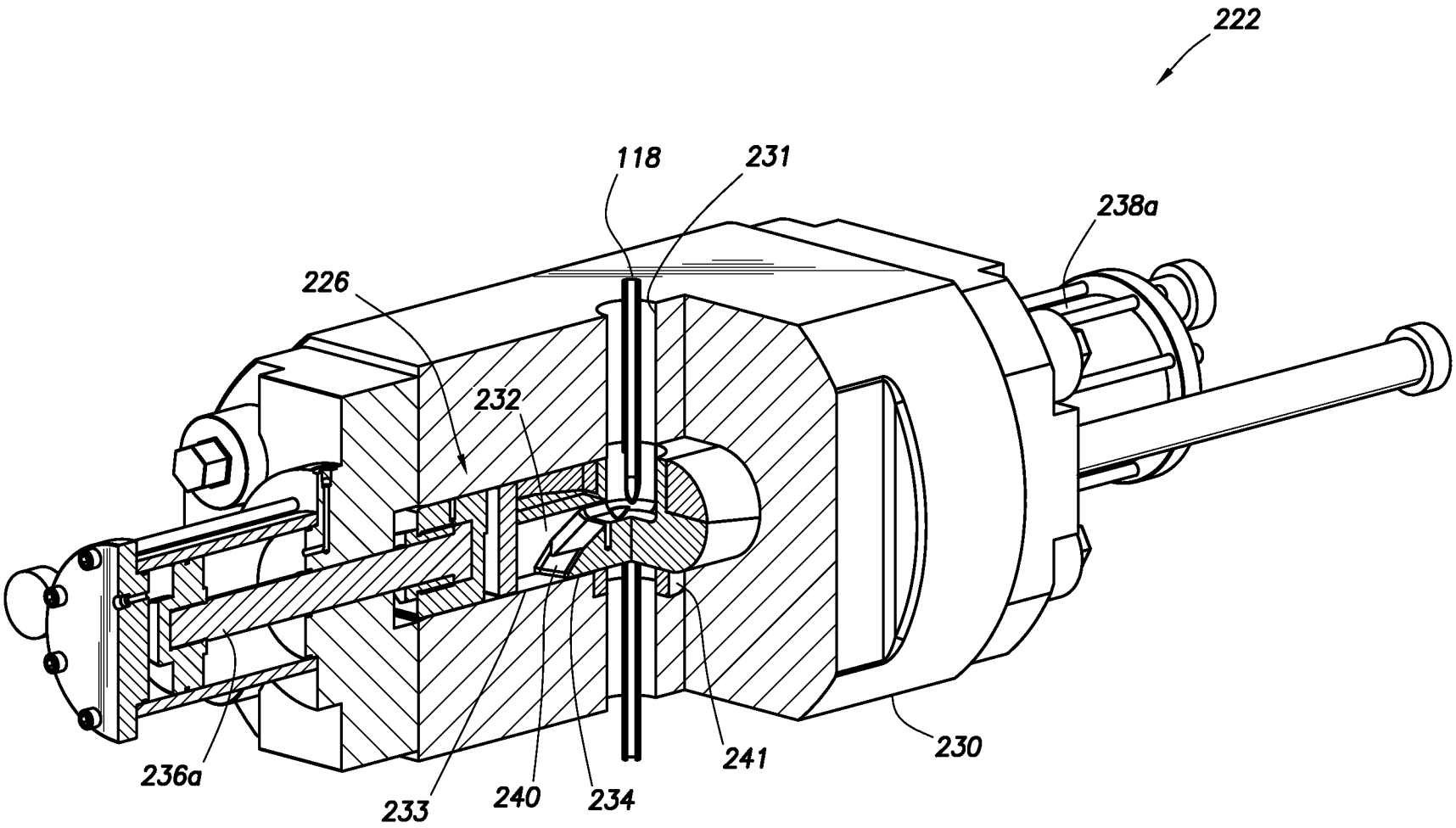
FIG. 2 is a partial cross-sectional view of a BOP with a wedge ram assembly.

FIG. 2 depicts a BOP 222 for severing a tubular 118. The BOP includes a housing 230 with a ram assembly 226 therein. The ram assembly 226 has an integrated configuration. The tubular 118 is positioned in a passage 231 extending vertically through the BOP 222. The ram assembly 226 is slidably positionable in a channel 233 extending horizontally through the BOP 222. The channel 233 intersects the vertical passage 231 and is in selective fluid communication therewith. While one ram assembly 226 is depicted in one BOP housing 230, one or more ram assemblies 226 may be positioned in one or more channels 233 in one or more BOP housings 230.

The ram assembly 226 includes a ram shuttle 232, a ram wedge 234, a ram piston 236*a*, and a cylinder 238*a*. The ram shuttle 232 is operatively connectable to piston 236*a* and cylinder 238*a*. The ram wedge 234 is operatively connectable to piston 236*b* (not visible in this view, but shown in FIGS. 3A-4B) and cylinder 238*b*. The ram wedge 234 may have a blade 240 for engaging the tubular 118. The blade 240 may be a separate component, such as a sharp metal piece inserted into the ram wedge 234. In some cases, no blade is provided. The blade 240 is drivable by movement of the wedge 234 such that the tubular 118 is severed as shown in FIG. 2. The ram assembly 226 is shaped to engage the tubular 118 during operation and form a seal with a ram seat 241 in the housing 230 as will be described further herein.

Figure 3A:
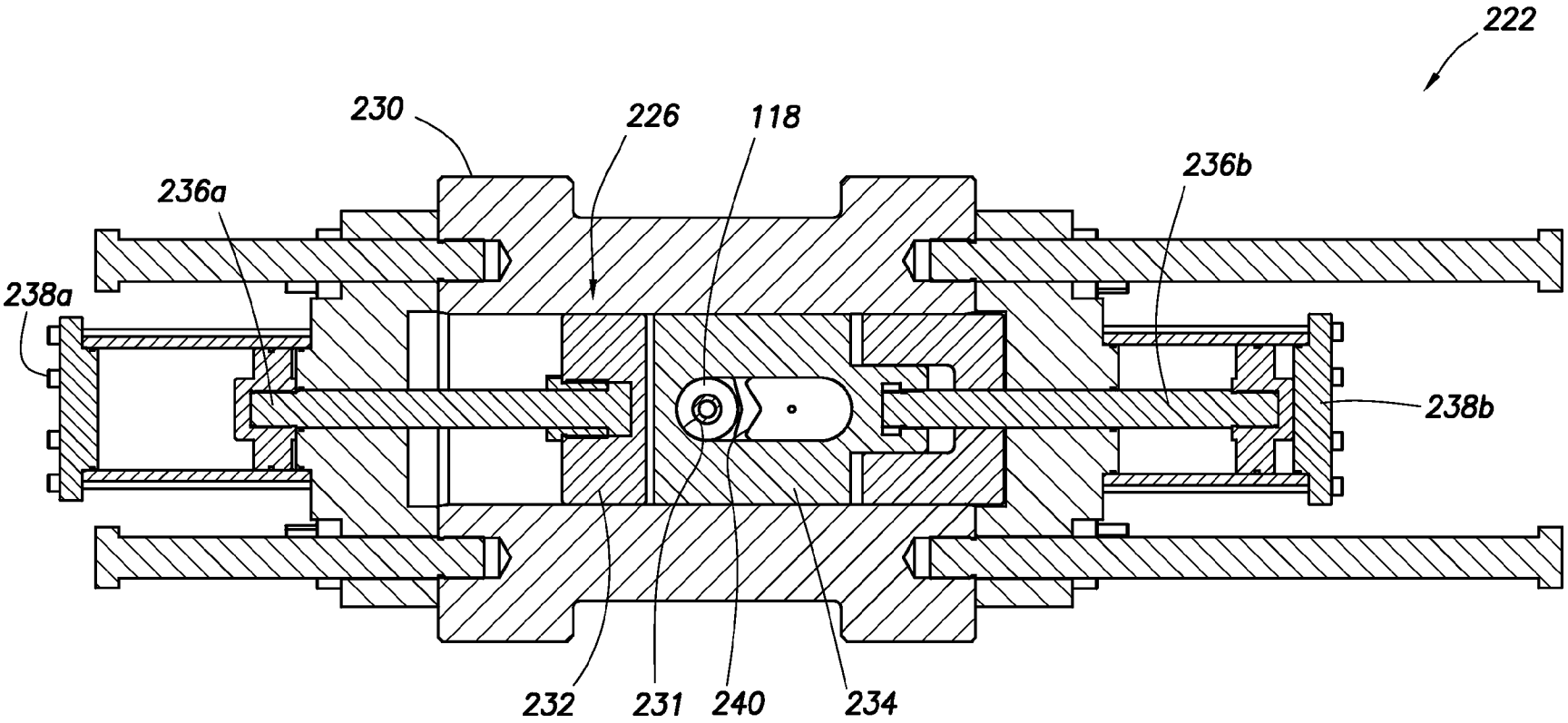
FIGS. 3A and 3B are horizontal and longitudinal cross-sectional views, respectively of the BOP of FIG. 2 with the wedge ram assembly in an open position.

FIGS. 3A-6B depict various views of the BOP 222 and the ram assembly 226 depicting operation thereof. FIGS. 3A and 3B depict horizontal and vertical views, respectively of the BOP 222 in an open (or unactivated) position. In this position, the ram assembly 226 is retracted to a disengaged position, and ready to perform a severing and sealing operation. FIGS. 4A and 4B depict horizontal and vertical views, respectively of the BOP 222 in an closed (or activated) position. In this position, the ram assembly 226 is extended to the engaged position after performing a severing and sealing operation.

As also shown in FIGS. 3A-4B, the BOP 222 includes a single ram assembly with dual pistons 236*a,b* and cylinders 238*a,b*. The ram shuttle 232 is driven by the piston 236*a* and cylinder 238*a*. The ram wedge 234 is driven by the piston 236*b* and cylinder 238*b*. The piston 236*a* may drive the ram shuttle 232 between the disengaged position of FIGS. 3A and 3B to the engaged position of FIGS. 4A and 4B. The ram wedge 234 may be driven by the piston 236*b* and cylinder 238*b* to a partially engaged position between the disengaged position of FIGS. 3A and 3B and the engaged position of FIGS. 4A and 4B.

Figure 3B:
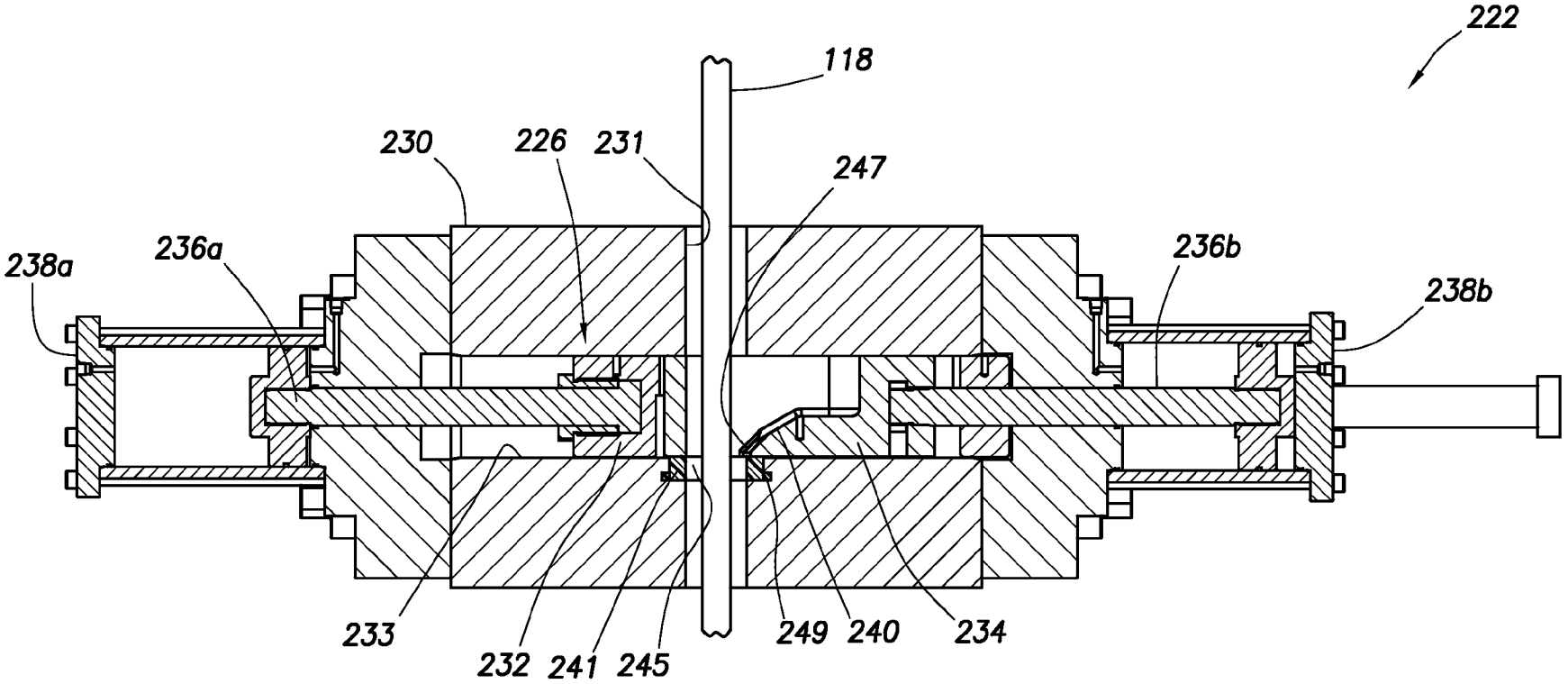
Figure 4A:
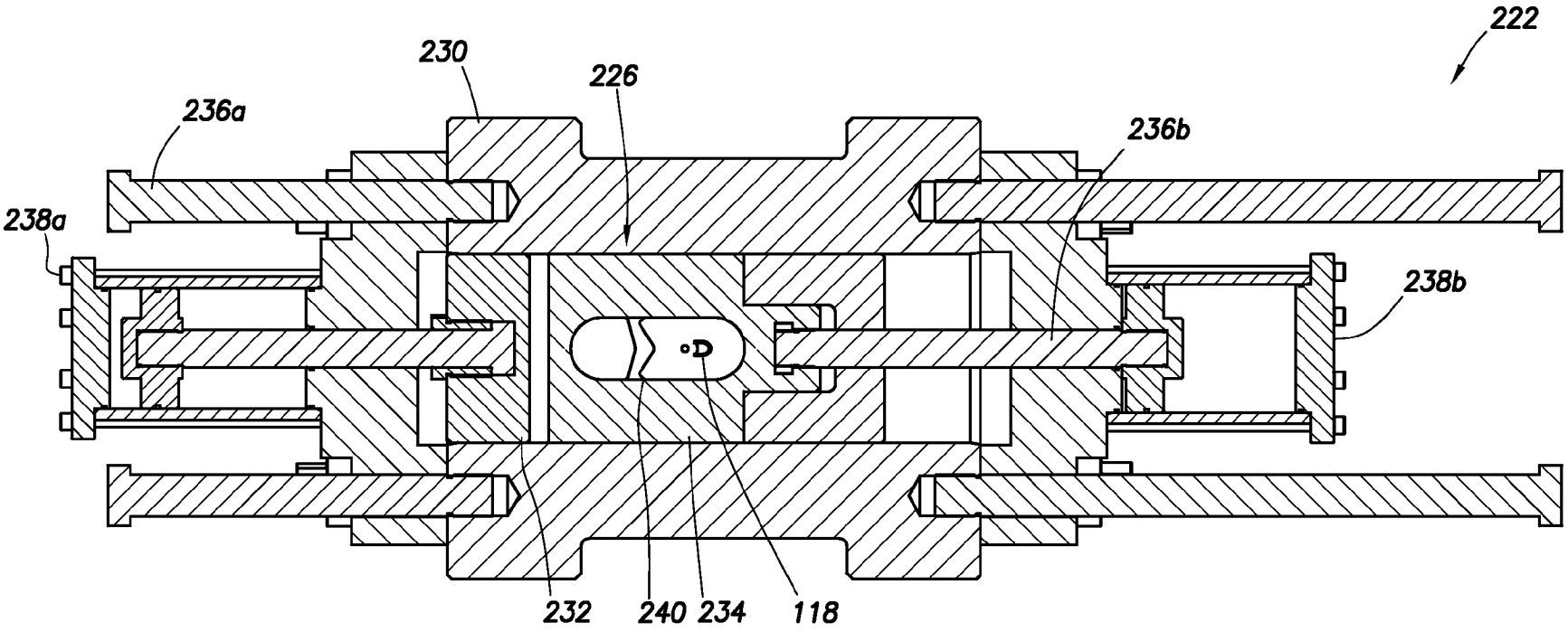
FIGS. 4A and 4B are horizontal and longitudinal cross-sectional views, respectively of the BOP of FIG. 2 with the wedge ram assembly in a closed position.
Figure 4B:
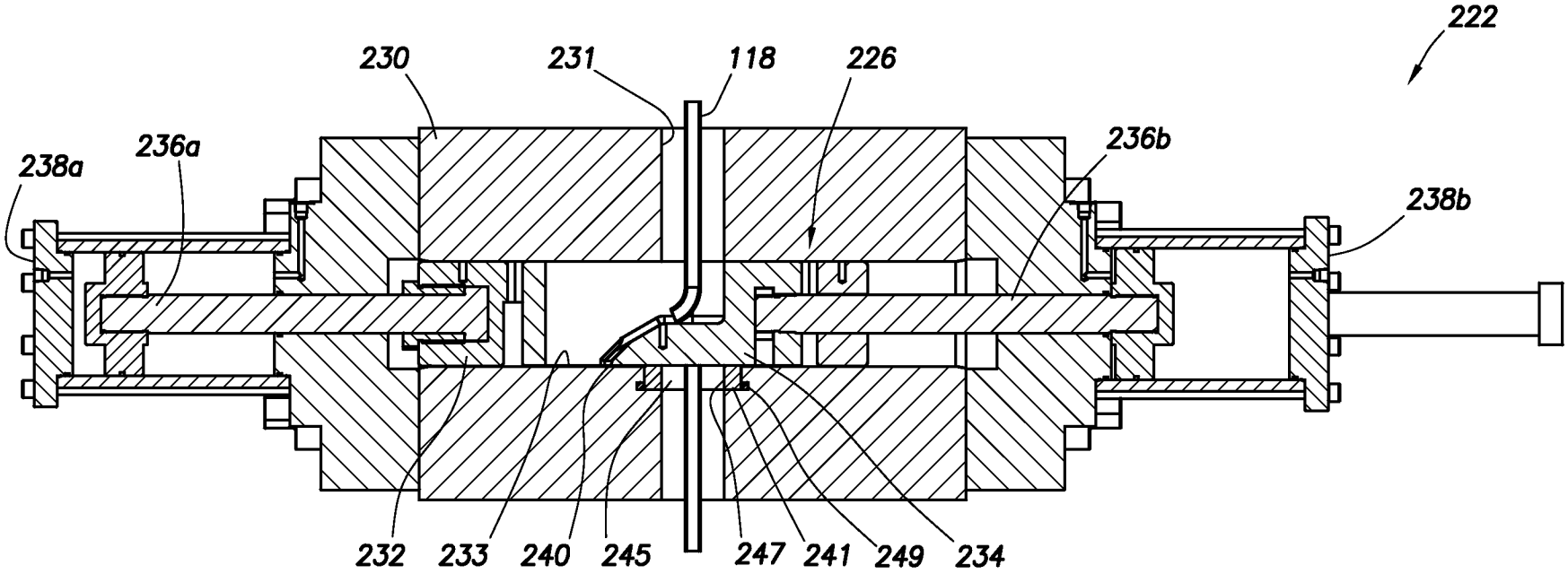

In an example, initially, the ram wedge 234 is moved from a retracted position of FIGS. 3A and 3B a distance partially toward the engaged position of FIGS. 4A and 4B by activation of piston 236*b* and cylinder 238*b*. The piston 236*b* may have a stroke to define the travel of the ram wedge 234 such that it extends partially, fully or otherwise as desired between the disengaged and engaged positions. This primary movement of the ram wedge 234 may drive the blade 240 of the ram wedge 234 through the tubular 118 and sever the tubular into two portions. Once the ram wedge 234 is moved, the ram shuttle 232 may then be activated in a secondary motion by piston 236*a* and cylinder 238*a* to move to the engaged position of FIGS. 4A and 4B. As the ram shuttle 232 advances, it sliding engages the ram wedge 234 and pushes on the ram wedge 234. This secondary movement of the ram wedge 234 by the ram shuttle 232 drives the ram wedge 234 to the fully engaged position of FIGS. 4A and 4B.

The ram seat 241 is positioned in a seal cavity 245 of the BOP 230. The ram seat 241 has an aperture 247 therethrough for fluid communication with passage 231. The sliding engagement of the ram shuttle 232 and ram wedge 234 provides mechanical interaction therebetween to generate forces for sealing against ram seat 241 as will be described further herein.

The ram seat 241 may be a metal seal capable of generating a metal to metal seal with the ram wedge 234. The ram seat 241 may optionally be made of other materials, such as elastomers, rubbers, etc. Additional seals 249 (or gaskets or other fluid restriction devices) may be positioned about the ram seat 241 for securing the ram seat in place and/or preventing the passage of fluid thereabout.

Figure 5A:
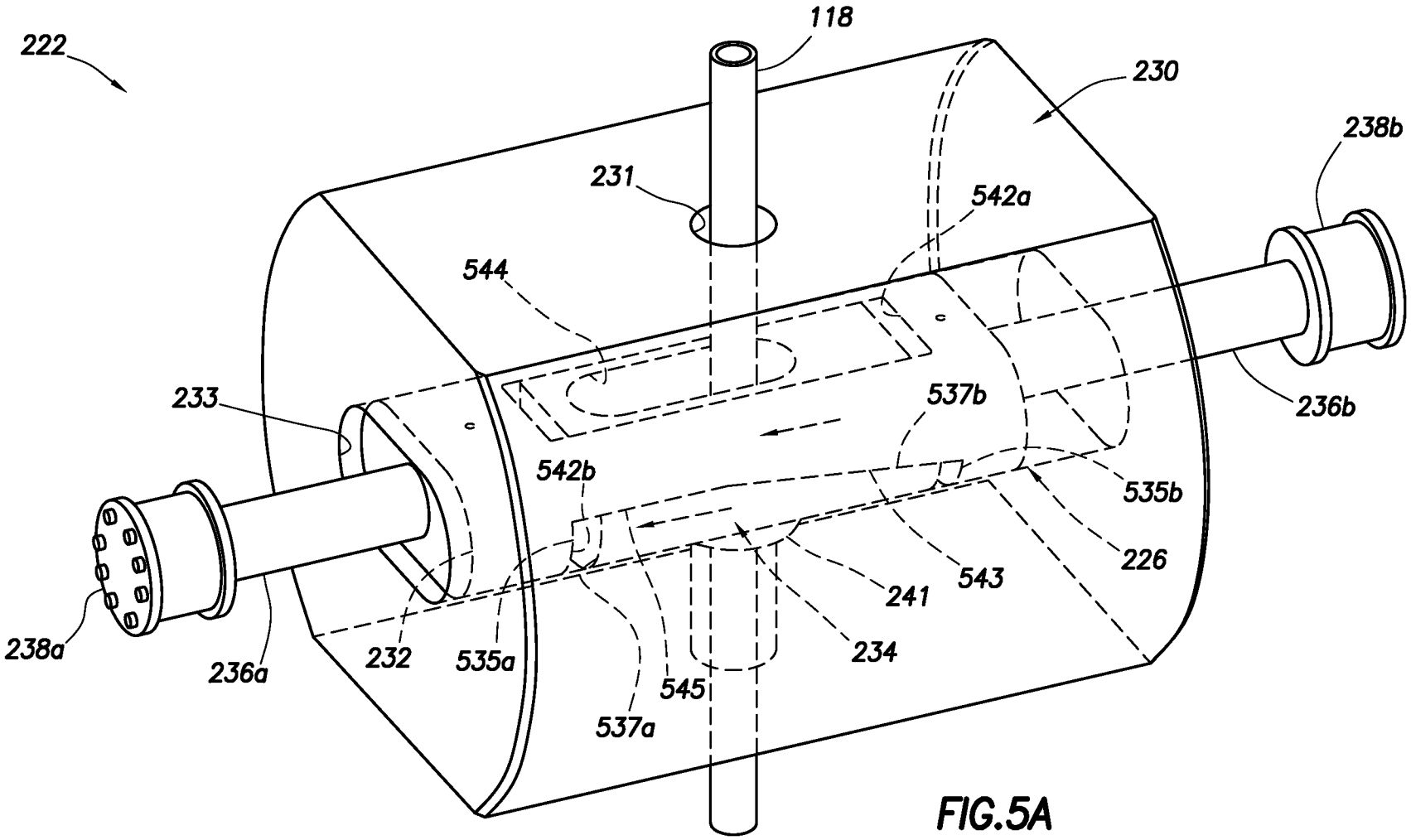
FIGS. 5A and 5B are perspective and plan views, respectively, partially transparent, of the BOP of FIG. 2 with the wedge ram assembly therein.
Figure 5B:
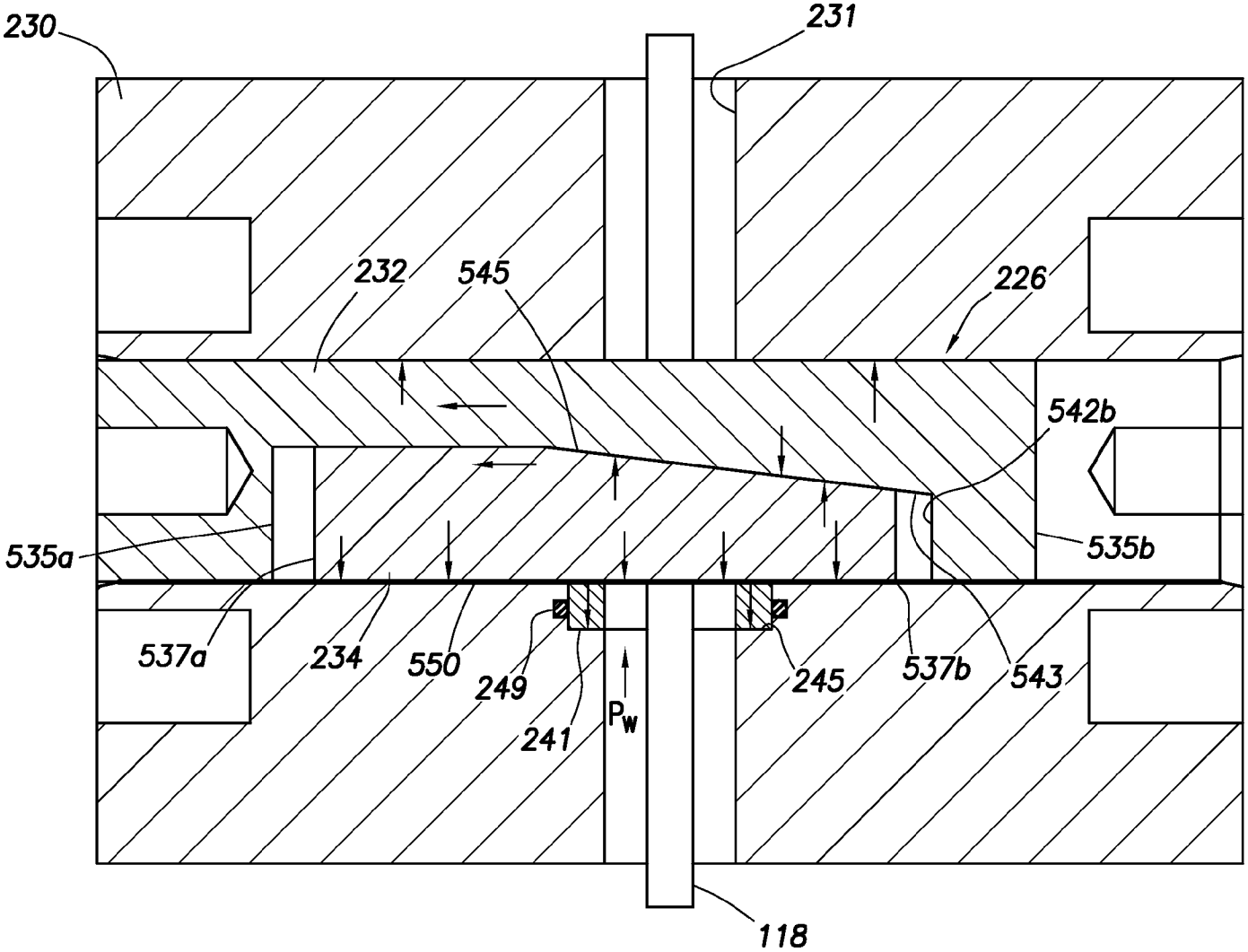
Figure 6A:
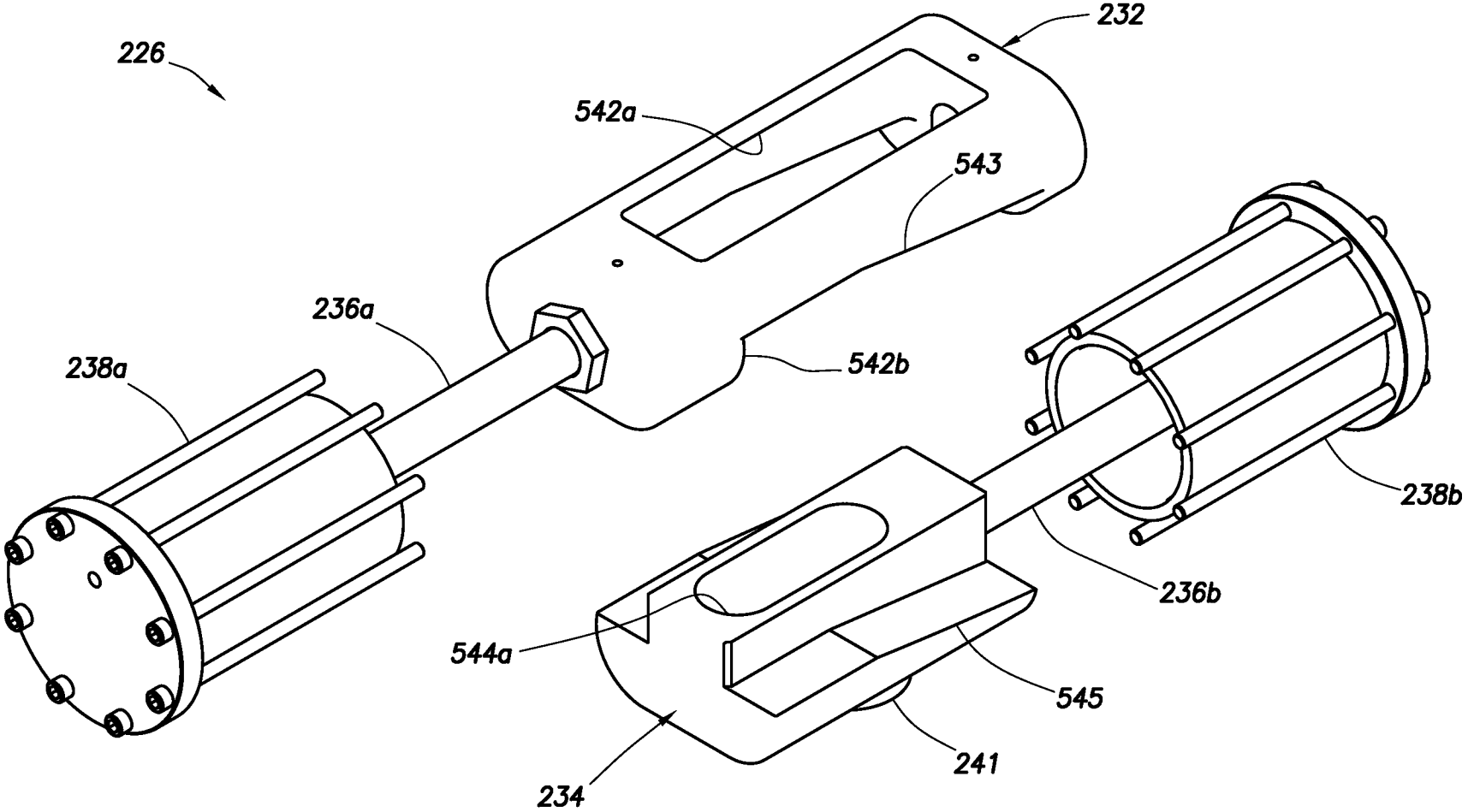
FIGS. 6A and 6B are top and bottom exploded views, respectively, of the wedge ram assembly of FIG. 5A.
Figure 6B:
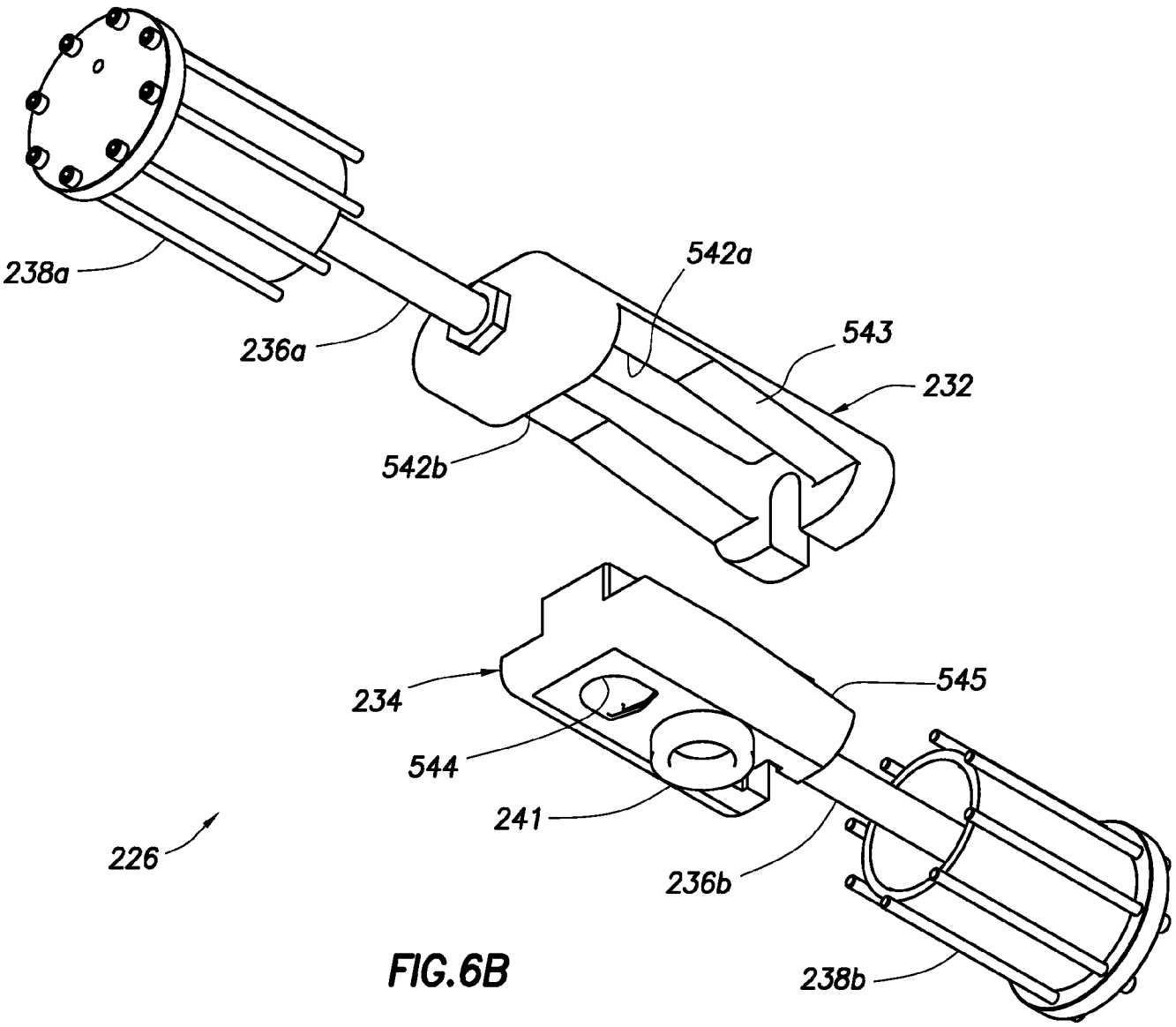

FIGS. 5A-6B depict additional views of the BOP 222 and ram assembly 226. As shown in FIG. 5A, the BOP housing 230 is transparent to show the ram assembly 226 positioned in channel 233 in the engaged position. As shown in FIG. 5B, a portion of the BOP housing 230 is depicted as transparent to show the ram assembly 226 in sealing engagement with ram seat 241. FIGS. 6A and 6B depict top and bottom, respectively, exploded views of the ram assembly 226.

The ram shuttle 232 is depicted as having a first cavity 542*a* for receiving a first portion of the ram wedge 234 and a second cavity 542*b* for receiving a second portion of the ram wedge 234. In this integrated configuration, a portion of the ram wedge 234 is maintained within the ram shuttle 232 during operation. The ram shuttle 232 also has a wedge surface 543 for slidable engagement with a shuttle surface 545 of the ram wedge 234. The ram shuttle 232 also has drive surfaces 535*a,b* for engagement with ends 537*a,b* of the ram wedge 234. The ram wedge 234 has a tubular cavity 544 for receiving the tubular 118.

The ram shuttle 232 is slidably engageable with the ram wedge 234. The wedge surface 543 and the shuttle surface 545 are corresponding inclined surfaces for slidable movement therealong. With the ram wedge 234 partially moved to the engaged position, the ram shuttle 234 may then be advanced along the ram wedge 234 by activation of piston 236*a* and cylinder 238*a* as indicated by the left arrow.

The ram shuttle 232 and ram wedge 234 mechanically interact as the shuttle surface 545 of the ram wedge 234 is advanced along the wedge surface 543 of the shuttle 232. The ram wedge 234 wedges between the ram shuttle 232 and the housing 230 thereby creating a force therebetween. The forces press the ram shuttle 232 and the ram wedge 234 together and against ram seat 241 and housing 230 as indicated by the arrows.

The forces between the ram wedge 234 and the ram seat 241 create a seal defining a fluid barrier 550 therebetween. The ram assembly 226 utilizes an outside applied force in combination with an angled ram wedge 234 to create the closing force required to affect a metal to metal seal about the BOP 222. This seal isolates well flow through the passage 231 and prevents fluid from entering the channel 233 of the BOP 222.

As the ram wedge 234 is moved to a partially and/or fully engaged position, anything (e.g., tubular 118) in the wellbore is sheared. The ram shuttle 232 then advances to the engages position until the angled surfaces on both the ram shuttle 232 and the ram wedge 234 meet. The interfering inclined surfaces 543, 545 create vertical movement between the ram shuttle 232 and the ram wedge 234. The ram wedge 234 pushes the ram shuttle 232 in a direction away from the ram seat such that the ram shuttle 232 contacts the housing 230 along an upper portion of the channel 233. The ram wedge 234 is also forced against the ram seat 241 such that the ram seat 241 is thereby forced against the seal pocket 245 in the housing 230. The force generated between the ram assembly 226, ram seat 241, and seal pocket 245 in the housing 230 may create a metal to metal seal at two points. A first seal is created between the ram assembly 226 and the ram seat 241. A second seal is created between the ram seat 241 and the seal pocket 245 in the housing 230. Due to the geometry of the assembly these two seals may each define a metal to metal seal that effectively isolates the wellbore outside of the channel 233.

While wellbore pressure Pw may be present (see, e.g., FIG. 5B), the ram assembly 226 does not require wellbore pressure to form the fluid barrier 550. Elastomers or other seals 249 are also not required (but optionally may be present) to seal or to assist in moving the seal assembly 226 to a sealed position.

Figure 7:
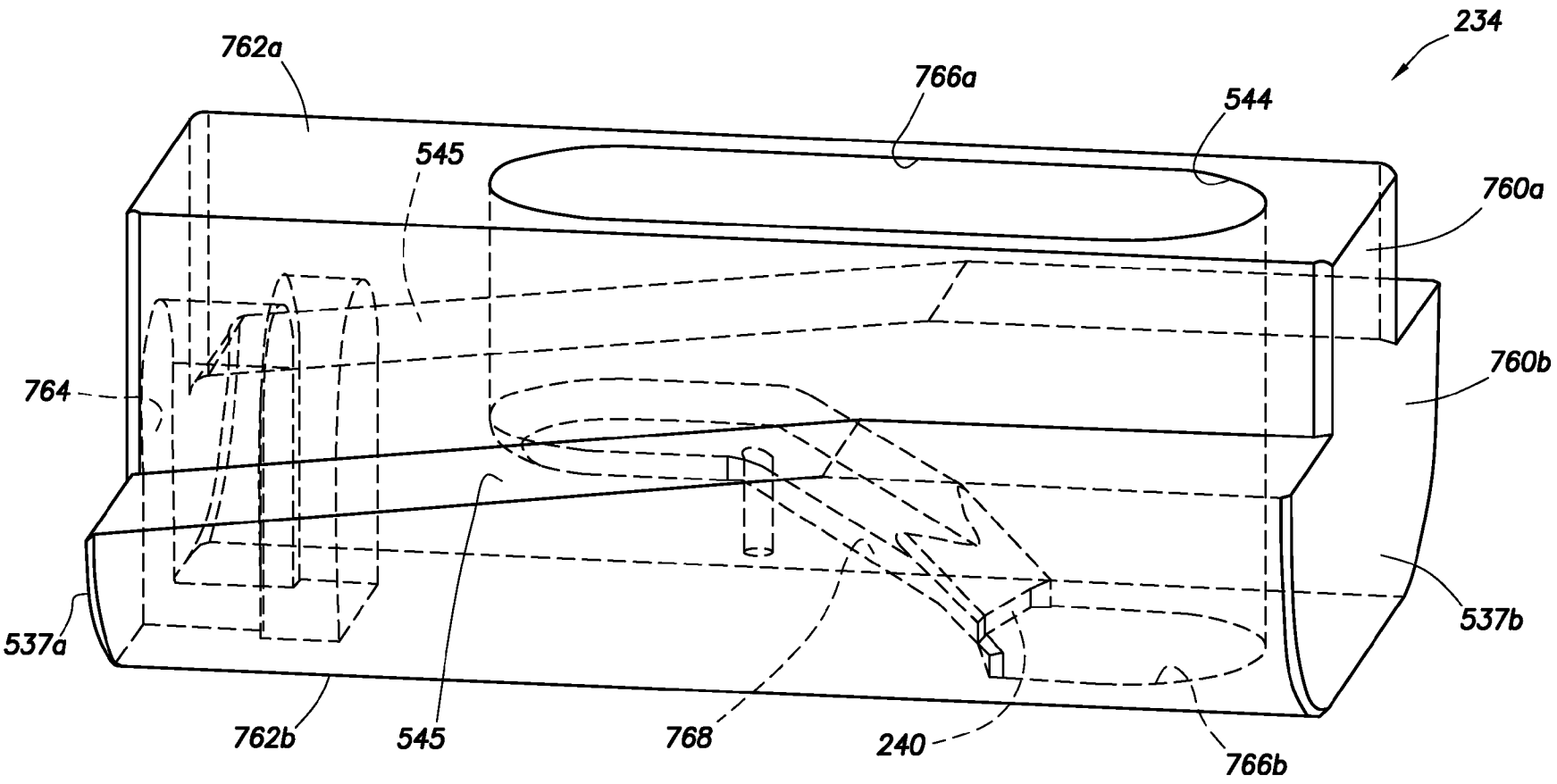
FIG. 7 is a perspective view of a ram wedge of the wedge ram assembly of FIG. 6A.

Referring to FIG. 7, the ram wedge 234 is shown in greater detail. As shown in this view, the ram wedge 234 has an inverted-T shaped body including a first portion 760*a* and a second portion 760*b*. The ram wedge 234 has a receptacle 764 for receiving the piston 236*b*. Tubular cavity 544 has an elongate opening 766*a* extending through first surface 762*a*, and a reduced opening 766*b* extending through second, opposite surface 762*b* of ram wedge 234. A shoulder 768 extends between the elongate opening 766*a* and the reduced opening 766*b* to provide an inclined transition therebetween. Blade 240 (if provided) is positioned along a slanted portion of the shoulder 768 adjacent reduced opening 766*b*.

Referring to FIGS. 4B and 7, the first portion 760*a* of ram wedge 234 is slidingly receivable in the first ram cavity 542*a* of the ram shuttle 232. The second portion 760*b* is positionable in a second cavity 542*b* of the ram shuttle 232. First and second surfaces 762*a,b* of ram wedge 234 are slidingly engageable with the BOP housing 230.

The shuttle surfaces 545 are positioned on opposite sides of the first portion 760*a*. A portion of the shuttle surfaces 545 may be inclined and a portion may be horizontal to define a travel path for movement of the ram shuttle 232 relative to the ram wedge 234. Ends 537*a,b* of ram wedge 234 are engageable with the ram shuttle 232 for receiving the sliding forces thereof.

The tubular 118 is receivable through elongate opening 766*a* and reduced opening 766*b* of tubular cavity 544. When present, the blade 240 is positioned such that, when the ram wedge 234 is advanced to the engaged position, the blade 240 engages and severs the tubular 118. As the tubular 118 is severed, the tubular 118 rests against the inclined portion of shoulder 768. The elongate opening 766 provides room for receiving the tubular 118 as the ram wedge 234 advances to the engaged position.

The bottom surface 762*b* adjacent reduced opening 766*b* provides a solid surface for covering passage 231 and hole 247 about the ram seat 241, and preventing fluid flow therethrough. The mechanical forces resulting from engagement between the ram shuttle 232 and ram wedge 234 within the channel 233 press against ram seat 241 to create a seal and provide the fluid barrier 550 therebetween. The fluid barrier 550 prevents fluid from the wellbore from passing through passage 231 from below the ram seat 241 and into the channel 233 where moving parts of the ram assembly 226 are located.

The ram assembly 226 provided herein is depicted in a specific orientation and configuration. However, variations are possible. For example, the ram assembly 226 may be inverted within the ram channel 233. Only one ram seat 241 is depicted, but one or more ram seats may be provided. For example, a ram seat 241 may be located upstream and/or downstream of the ram assembly 226, and may be engageable by one or more ram assemblies 226. The ram assembly 226 is depicted in a gate valve type configuration with a single ram wedge, but could include one or more gate, opposing or other type of rams.

The ram assembly 226 is depicted as providing a metal to metal seal that isolates fluid flow and prevents fluid from the wellbore from entering cavity 233. The seal is depicted as being driven by mechanical forces resulting from activation of the ram shuttle 232 and ram wedge 234. The seal formed by the ram assembly 226 may also employ other forces, such as wellbore pressure, but does not need such additional forces to generate the necessary closing force to affect the seal and create the fluid barrier.

Figure 8:
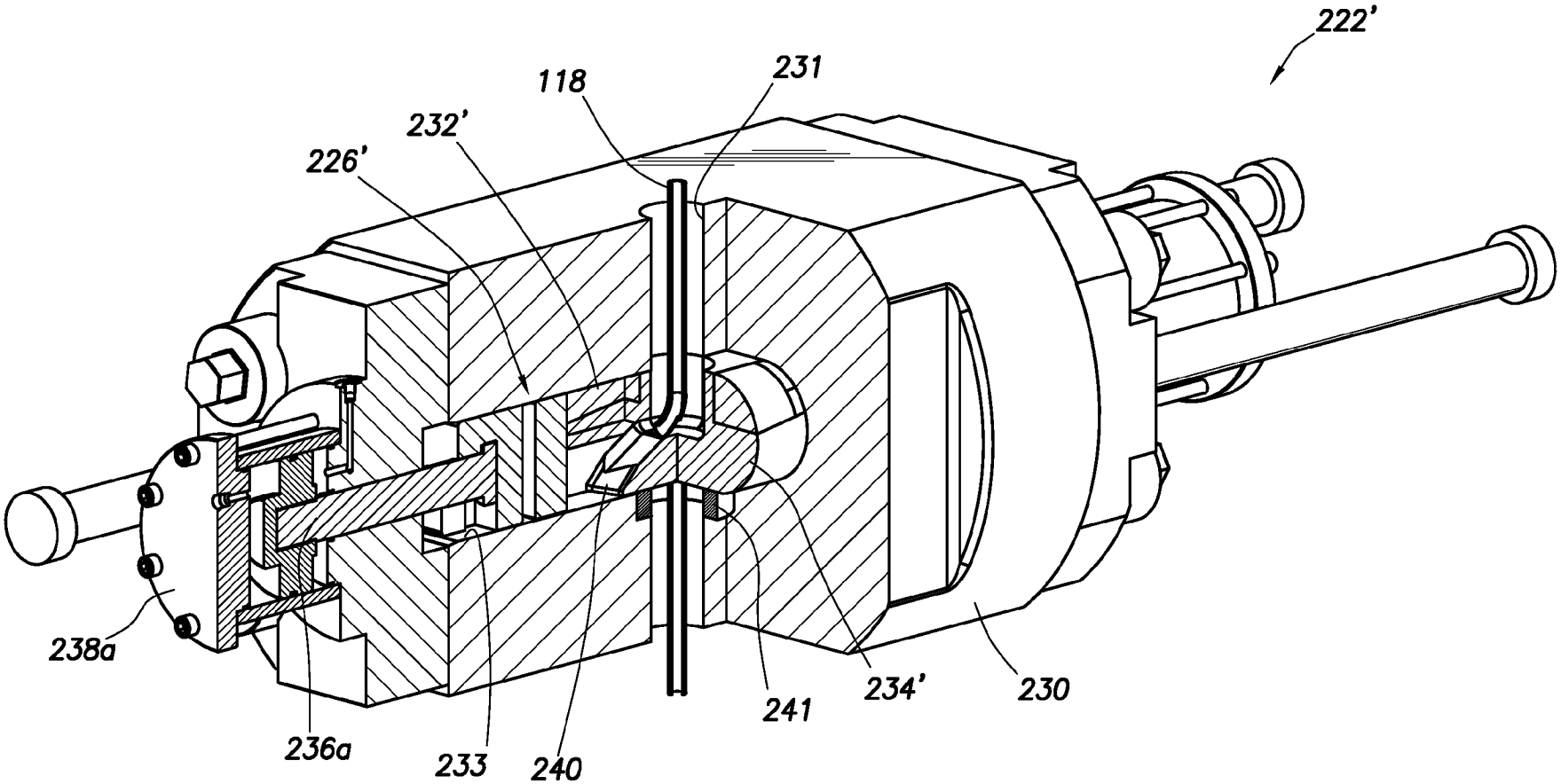
FIG. 8 is a partial cross-sectional view of BOP with another wedge ram assembly.

FIG. 8 depicts a modified BOP 222' for severing a tubular 118. The BOP 222' is the same as BOP 222 as previously described, except that the ram assembly 226' has a different configuration. The ram assembly 226' includes a modified ram shuttle 232' separate from and engageable with a modified ram wedge 234'. In this version, the ram assembly 226' has a separate configuration. Since the ram shuttle has an open end 970, the end 535*b* of ram shuttle 232' is removed and end 537*b* of ram wedge 234 engages the housing 230 rather than ram wedge 537*b*. The modified ram shuttle 232' is open ended to slidingly receive the modified ram wedge 234'.

Figure 9A:
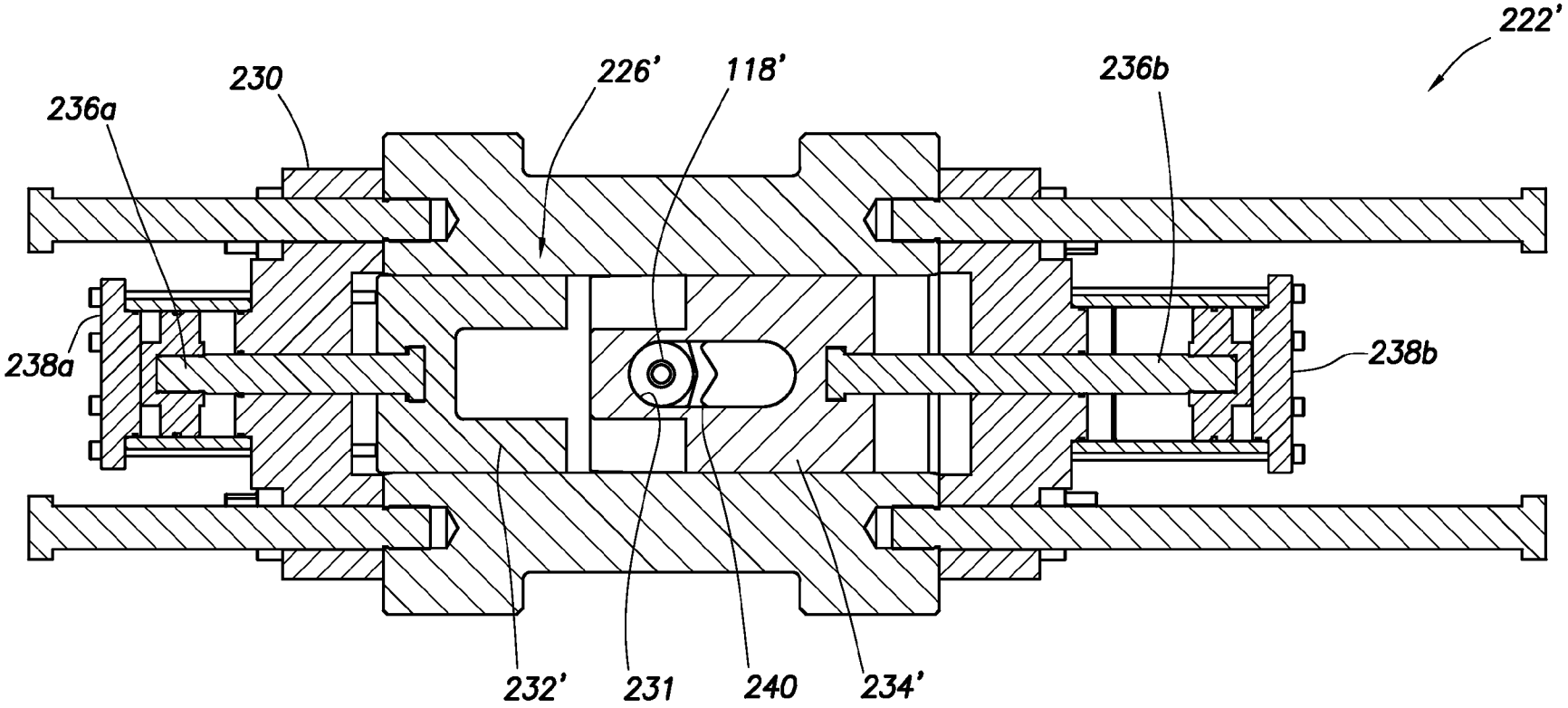
FIGS. 9A and 9B are horizontal and longitudinal cross-sectional views, respectively of the BOP of FIG. 8 with another wedge ram assembly in an open position.
Figure 9B:
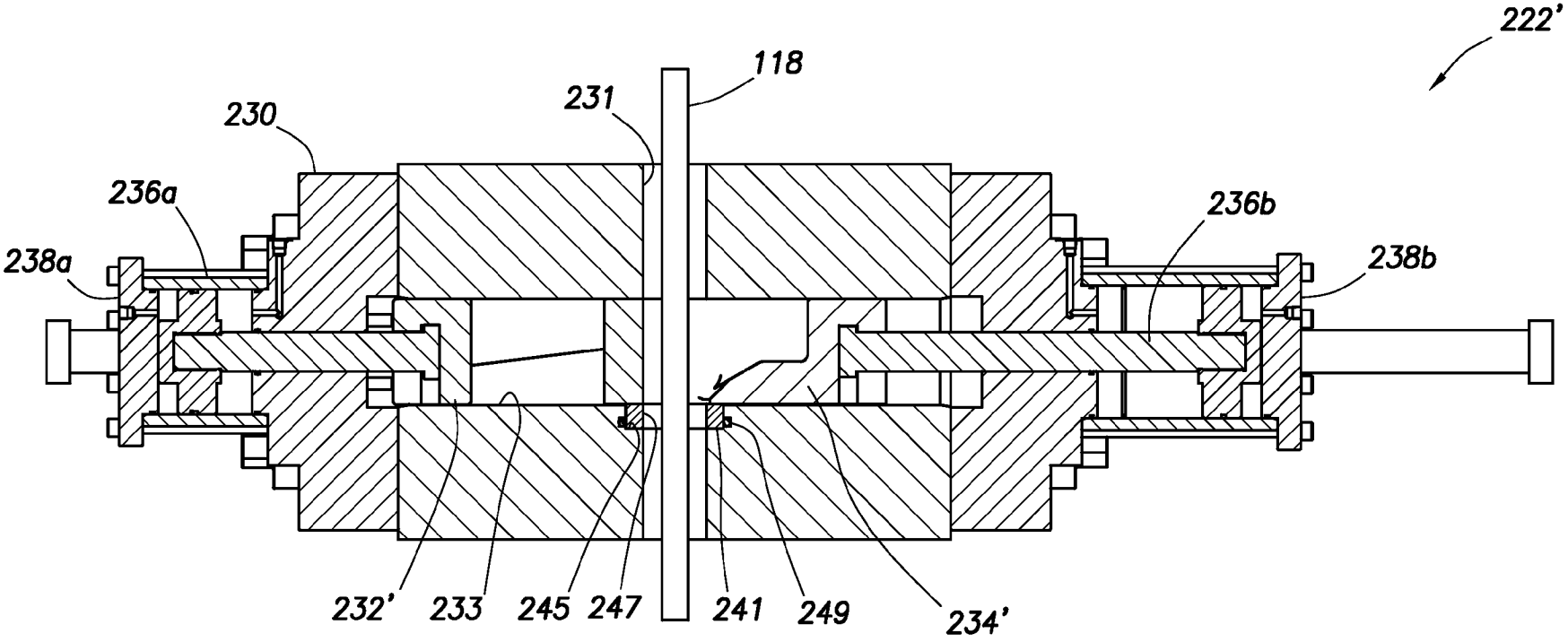
Figure 10A:
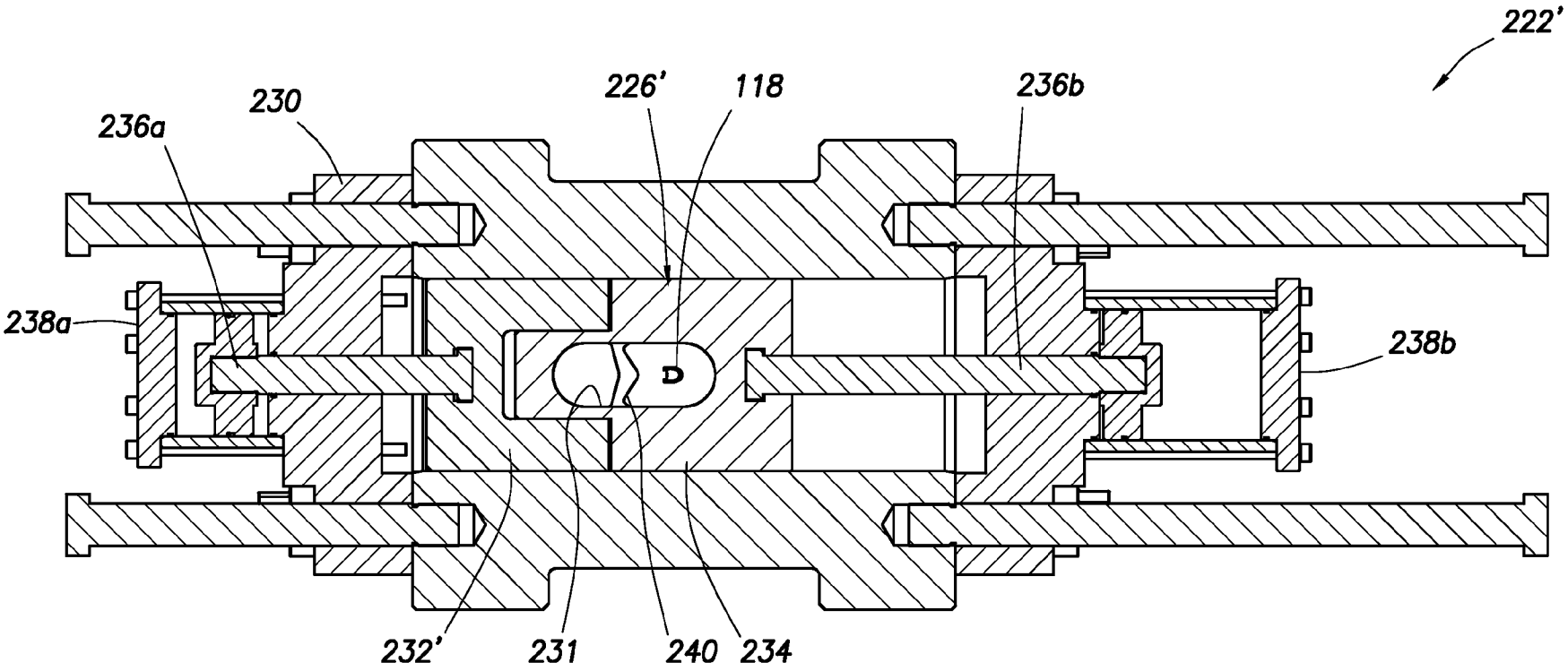
FIGS. 10A and 10B are horizontal and longitudinal cross-sectional views, respectively of the BOP of FIG. 8 with another wedge ram assembly in a closed position.
Figure 10B:
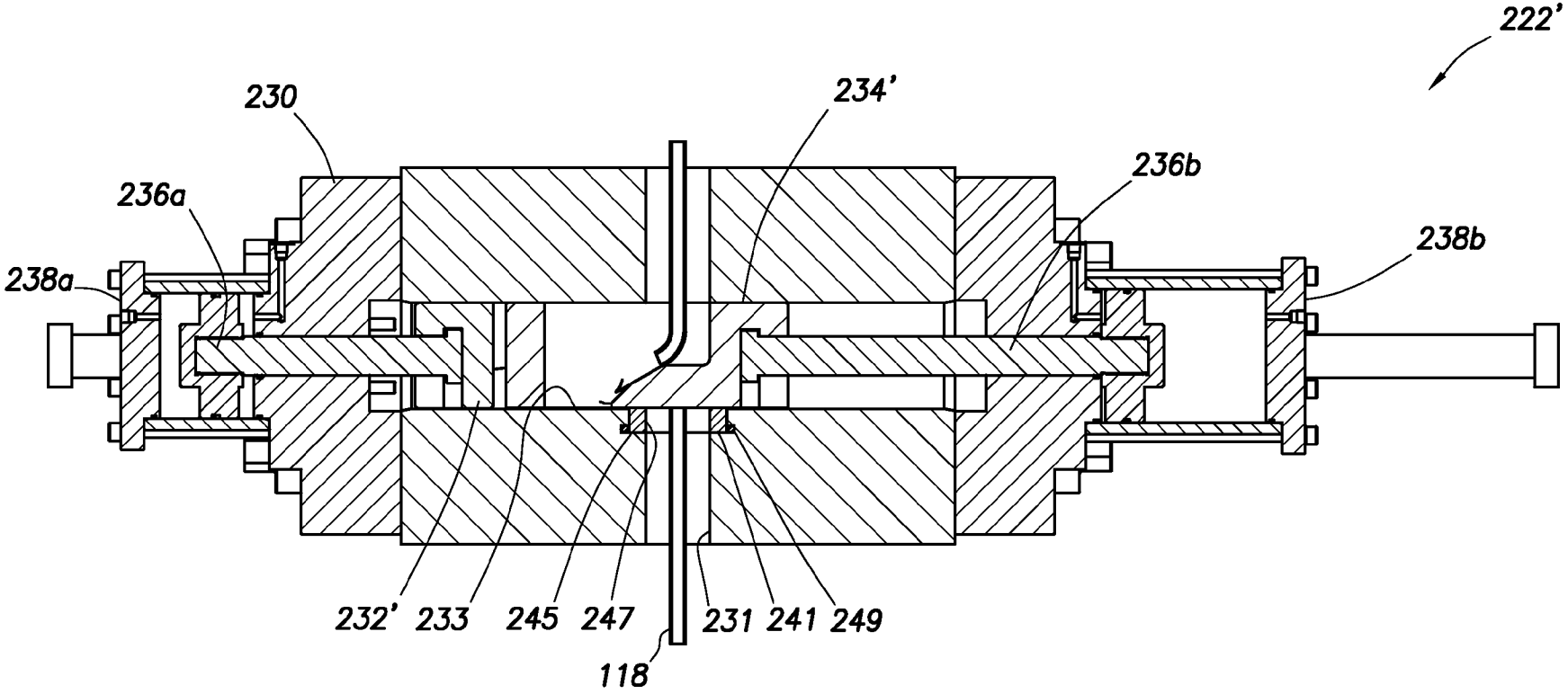

FIGS. 9A-10B depict various views of the BOP 222' and the ram assembly 226' depicting operation thereof. FIGS. 9A and 9B depict horizontal and vertical cross-sectional views, respectively of the BOP 222' in an open (or unactivated) position. In this position, the ram assembly 226' is retracted to a disengaged position, and ready to perform a severing and sealing operation. FIGS. 10A and 10B depict horizontal and vertical cross-sectional views, respectively of the BOP 222' in a closed (or activated) position. In this position, the ram assembly 226' is extended to the engaged position after performing a severing and sealing operation.

As shown in FIGS. 9A-10B, the ram assembly 226' is the same as ram assembly 226, except that the ram shuttle 232' and ram assembly 234' have been modified for independent movement. The ram shuttle 232' is the same as ram shuttle 232, except that the ram shuttle has an open end 970 for receiving the ram wedge 234. The ram shuttle 232' is slidably movable in cavity 233 via piston 236*a* and cylinder 238*a* and the ram wedge 234' is slidably movable in cavity 233 via piston 236*b* and cylinder 238*b* as previously described, but in a different sequence. In this operation, the ram shuttle 232' and the ram wedge 234' move towards each other from the disengaged position of FIGS. 9A and 9B to the engaged position of FIGS. 10A and 10B.

In an example operation, the ram wedge 234' is advanced to a partially engaged position by activation of piston 236*b* and cylinder 238*b*. In this primary movement, the ram wedge 234' severs the tubular. The ram shuttle 232' may then advance to the engaged position by moving towards the ram wedge 234' by activation of piston 236*a* and cylinder 236*a*. The piston 236*b* and cylinder 238*b* may continue to apply a force to prevent retraction of the ram wedge 234'.

Figure 11A:
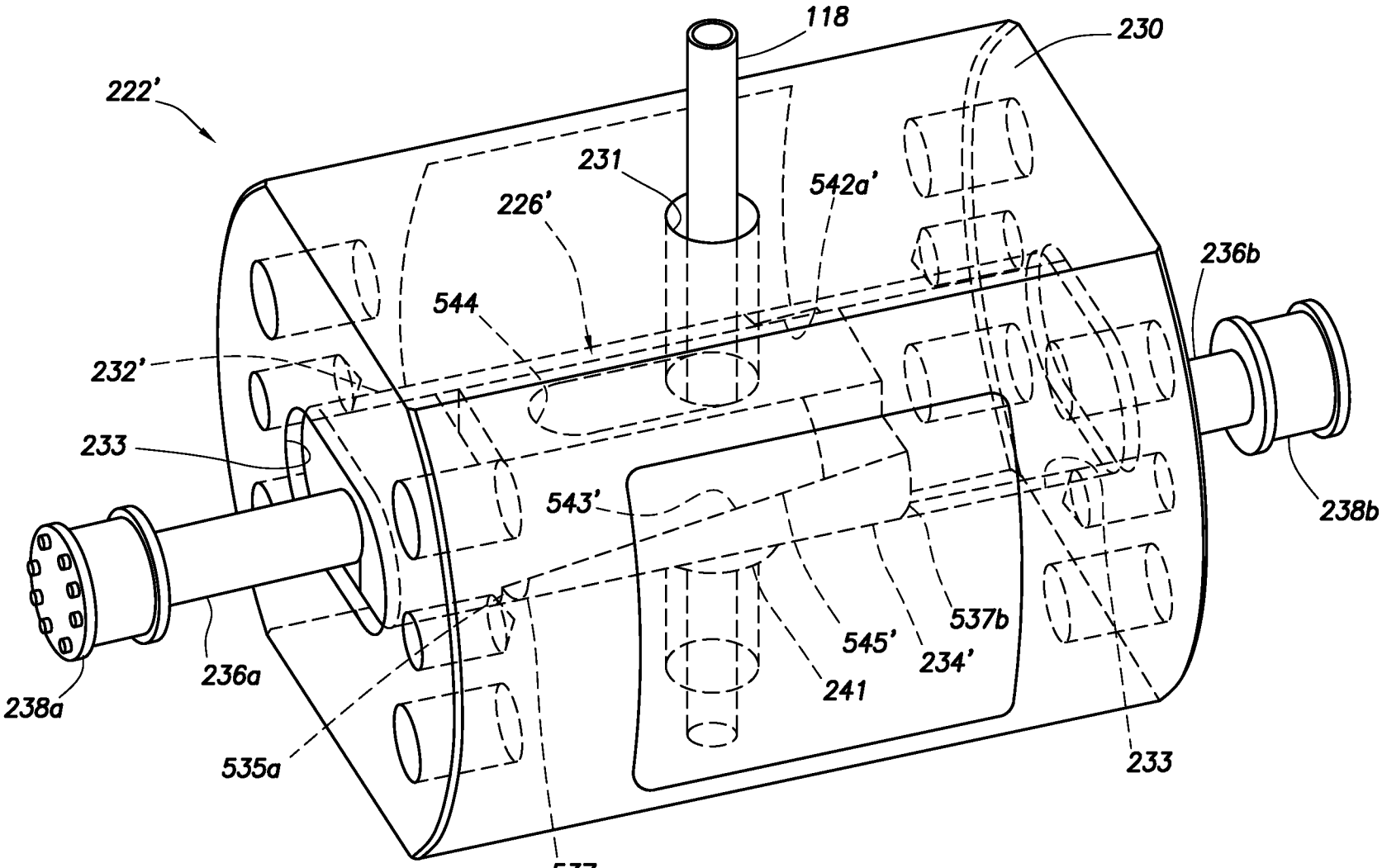
FIGS. 11A and 11B are perspective and plan views, respectively, partially transparent, of the BOP of FIG. 8 with the wedge ram assembly therein.
Figure 11B:
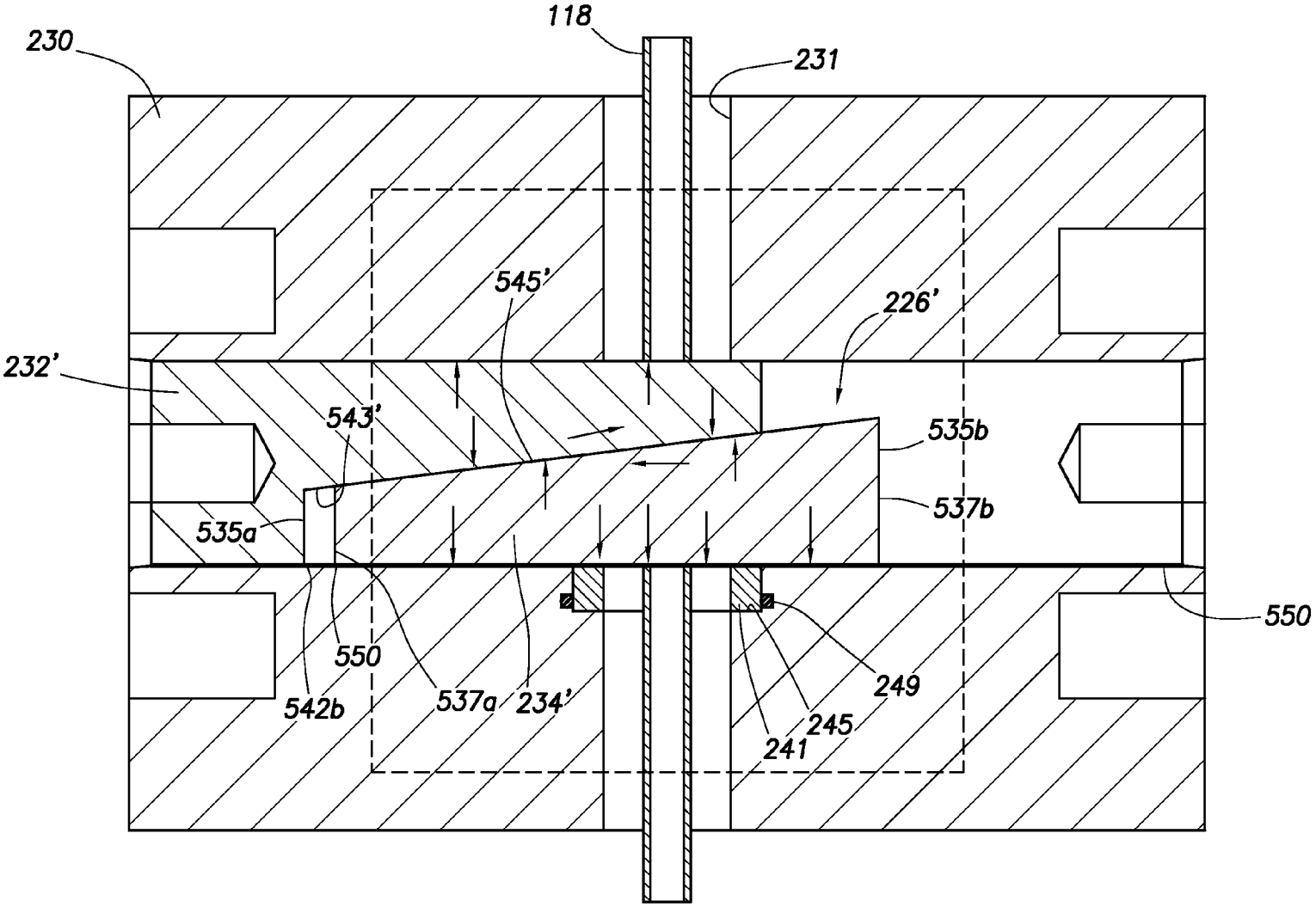
Figure 12A:
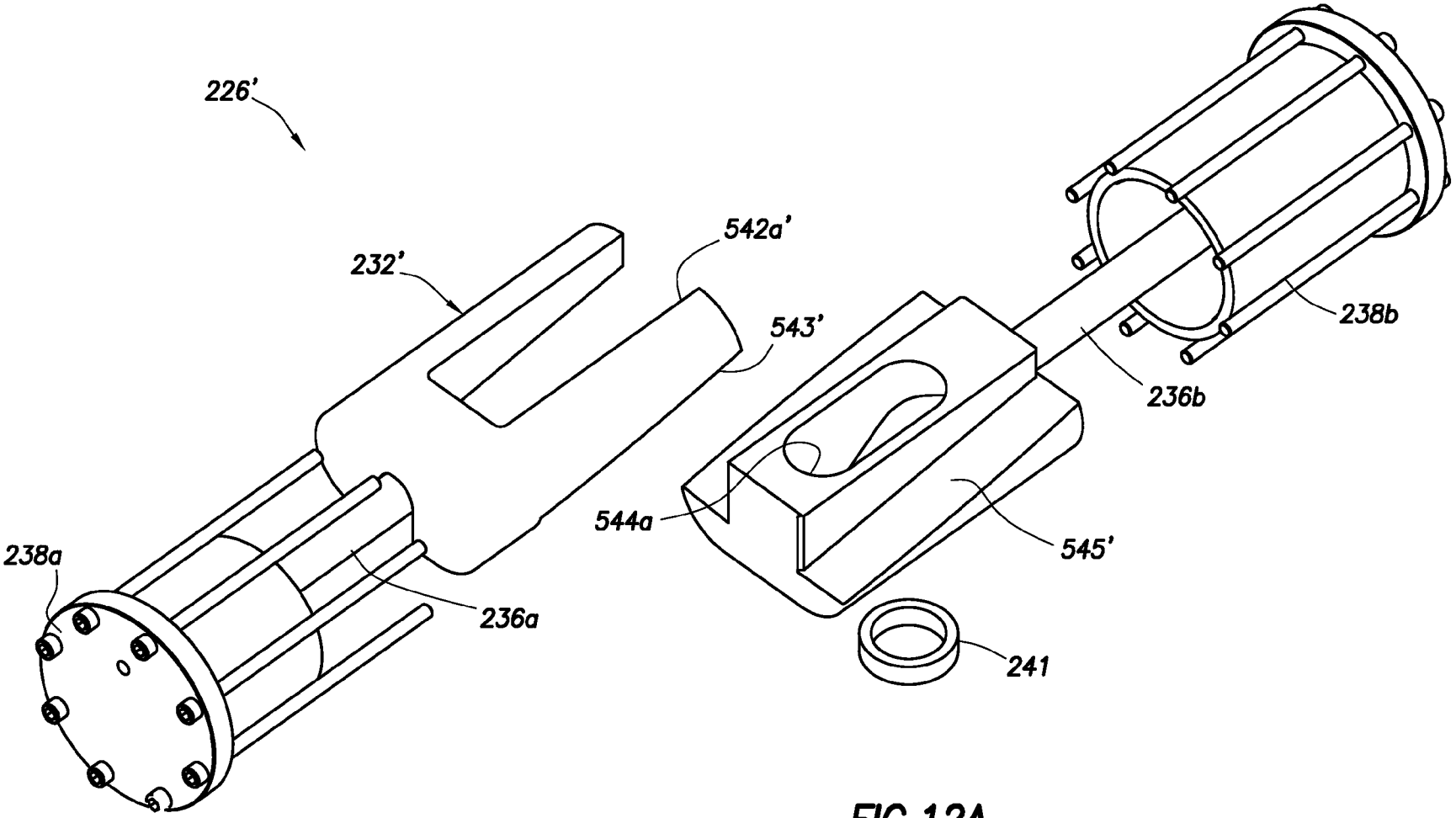
FIGS. 12A and 12B are top and bottom exploded views, respectively, of the wedge ram assembly of FIG. 11A.
Figure 12B:
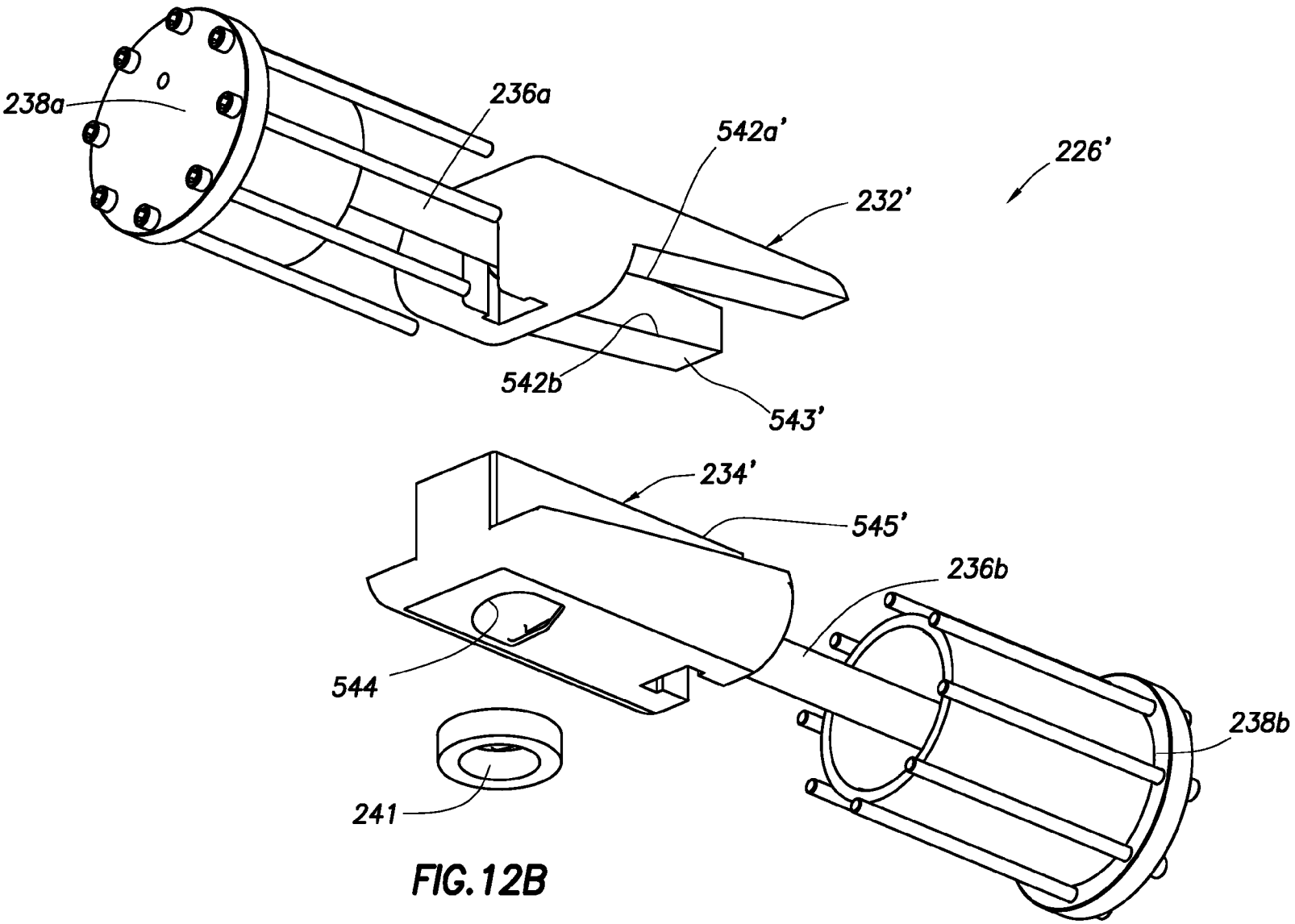
Figure 13:
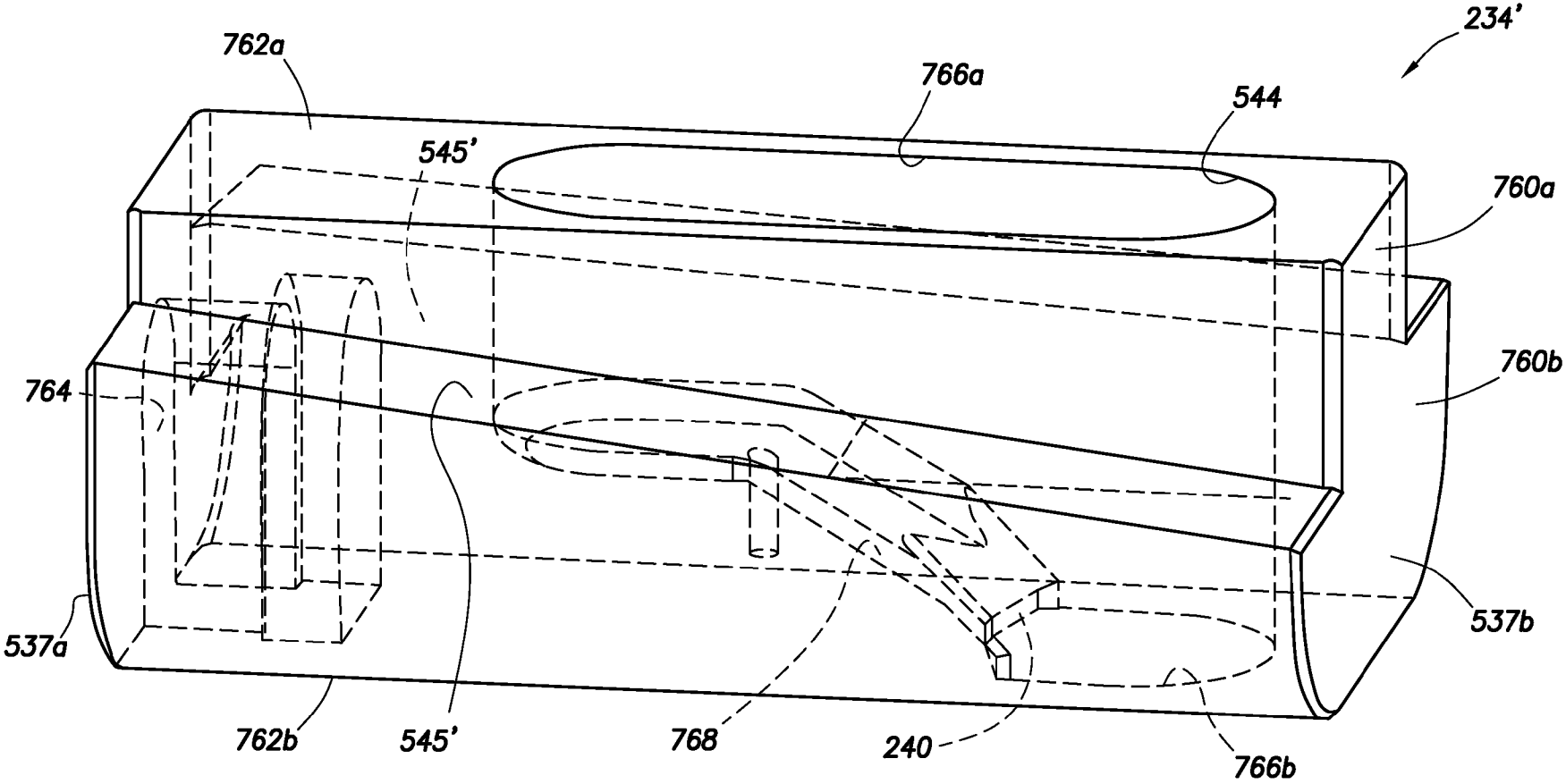
FIG. 13 is a perspective view of a ram wedge of the wedge ram assembly of FIG. 12A.

FIGS. 11A-13 show the modified ram assembly 226' in greater detail. FIGS. 11A and 11B show the ram assembly 226' in BOP housing 230. FIGS. 12A and 12B show exploded views of the ram assembly 226'. FIG. 13 shows a detailed view of the modified ram wedge 234'. As shown in these figures, the ram wedge 234' and ram shuttle 232' have modified inclined surfaces 543', 545' for slidable engagement therebetween.

The modified ram shuttle 234' is receivable by a modified upper portion 542*a* of the wedge cavity 544 as the ram shuttle 234' and the ram wedge 232' move together. The ram wedge 234' slidingly engages the ram shuttle 232'. While the movement between the ram wedge 234' and the ram shuttle 232' is different, the ram wedge 234' wedges between the ram shuttle 234' and the housing 230 to generate a mechanical force as previously described.

As shown in FIG. 13, the inclined surface 545' has been modified to incline in the reverse direction from the inclined surface 545 previously described. The inclined surface 545' is also inclined along the entire length of ram wedge 234'. As shown in FIGS. 11A-12B, ram shuttle 232' has a corresponding inclined surface 543'.

Figure 14:
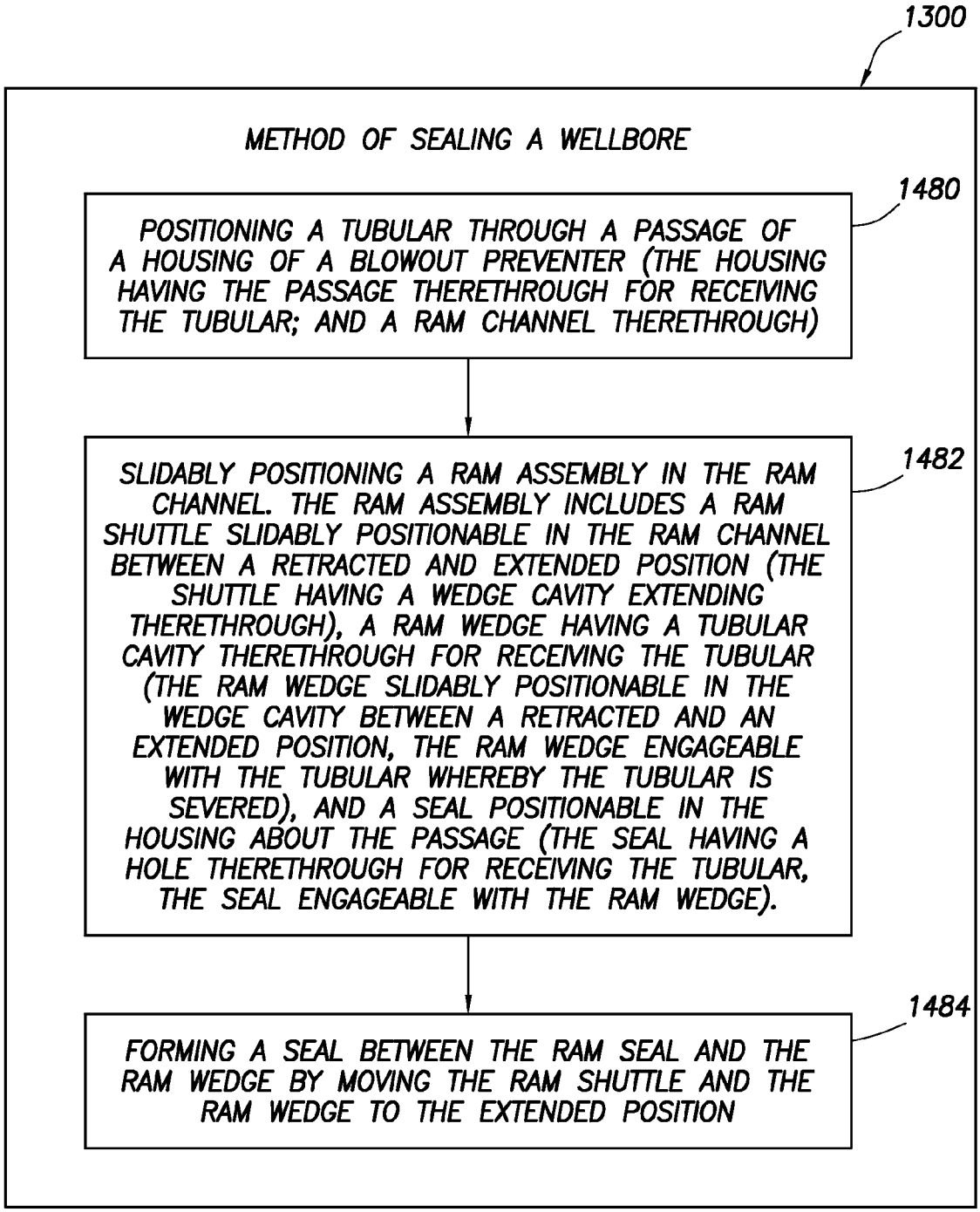
FIG. 14 is a flow chart depicting a method of sealing a wellbore.

FIG. 14 provides a method 1300 of sealing a wellbore. The method 1300 involves (1480) positioning a tubular through a passage of a housing of a blowout preventer (the housing having the passage therethrough for receiving the tubular; and a ram channel therethrough). The method also involves (1482) slidably positioning a ram assembly in the ram channel. The ram assembly includes a ram shuttle slidably positionable in the ram channel between a retracted and extended position (the shuttle having a wedge cavity extending therethrough), a ram wedge having a tubular cavity therethrough for receiving the tubular (the ram wedge slidably positionable in the wedge cavity between a retracted and an extended position, the ram wedge engageable with the tubular whereby the tubular is severed), and a seal positionable in the housing about the passage (the seal having a hole therethrough for receiving the tubular, the seal engageable with the ram wedge). The method continues by (1484) forming a seal between the ram seat and the ram wedge by moving the ram shuttle and the ram wedge to the extended position.

The forming may be achieved by moving the ram shuttle and ram seal in the same direction, in opposing directions, independently, integratedly and combinations thereof. The methods may be performed in any order, or repeated as desired. Various combinations of the methods may also be provided.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more wedge ram assemblies with one or more rams may be provided in one or more orientations within a housing of the BOP.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A ram assembly of a blowout preventer for sealing a wellbore, the blowout preventer having a housing with a passage therethrough for receiving a tubular of the wellbore and a ram channel therethrough, the ram assembly comprising:

a ram shuttle slidably positionable in the ram channel between a retracted and extended position, the ram shuttle having a wedge cavity extending therethrough and an inclined surface thereon;

a ram wedge having a tubular cavity therethrough for receiving the tubular, the ram wedge slidably positionable in the wedge cavity between a retracted and an extended position, the ram wedge having a corresponding inclined surface engageable with the inclined surface of the ram shuttle to wedge between the ram shuttle and the housing of the blowout preventer whereby a force is generated therebetween, the ram wedge engageable with the tubular; and a ram seat positionable in the housing about the passage, the ram seat having a hole therethrough for receiving the tubular, the ram seat engageable with the ram wedge and the housing of the blowout preventer when the ram shuttle and the ram wedge are moved to the extended position whereby a seal is formed therebetween.

2. The ram assembly of claim 1, wherein in the extended position the ram wedge forms a fluid barrier between the channel and the ram seat.

3. The ram assembly of claim 1, further comprising a blade positionable on the ram wedge and engageable with the tubular whereby the tubular is severed.

4. The ram assembly of claim 1, wherein the ram shuttle has a closed end.

5. The ram assembly of claim 1, wherein the ram shuttle has an open end.

6. The ram assembly of claim 1, wherein the ram shuttle and the ram wedge move in the same direction.

7. The ram assembly of claim 1, wherein the ram shuttle and the ram wedge move in opposite directions.

8. The ram assembly of claim 1, wherein the tubular cavity has a first portion and a second portion with a tapered shoulder therebetween, the first portion larger than the second portion.

9. The ram assembly of claim 1, wherein the wedge cavity has a first portion for receiving a first portion of the ram wedge and wherein the wedge cavity has a second portion for receiving the second portion of the ram wedge, the second portion of the ram wedge being wider than the first portion of the ram wedge.

10. The ram assembly of claim 1, wherein the ram shuttle and the ram wedge have corresponding inclined surfaces for sliding engagement therebetween.

11. The ram assembly of claim 1, further comprising a piston and a cylinder operatively connectable to the ram shuttle for driving movement thereof.

12. The ram assembly of claim 1, further comprising a piston and a cylinder operatively connectable to the ram wedge for driving movement thereof.

13. The ram assembly of claim 1, wherein the ram seat is a metal to metal seal.

14. The ram assembly of claim 1, further comprising at least one additional seal.

15. A blowout preventer for sealing a wellbore, the wellbore having a tubular extending therefrom for passing therethrough, comprising:

a housing having a passage for receiving the tubular and a ram channel therethrough; and at least one ram assembly, comprising:

a ram shuttle slidably positionable in the ram channel between a retracted and extended position, the ram shuttle having a wedge cavity extending therethrough and an inclined surface thereon;

a ram wedge having a tubular cavity therethrough for receiving the tubular, the ram wedge slidably positionable in the wedge cavity between a retracted and an extended position, the ram wedge having a corresponding inclined surface engageable with the inclined surface of the ram shuttle to wedge between the ram shuttle and the housing of the blowout preventer whereby a force is generated therebetween, the ram wedge engageable with the tubular; and a ram seat positionable in the housing about the passage, the ram seat having a hole therethrough for receiving the tubular, the ram seat engageable with the ram wedge and the housing of the blowout preventer when the ram shuttle and the ram wedge are moved to the extended position whereby a seal is formed therebetween.

16. The blowout preventer of claim 15, further comprising at least one controller.

17. A method for sealing a wellbore, the wellbore having a tubular extending therefrom for passing therethrough, comprising:

providing a blowout preventer comprising:

a housing having a passage and a ram channel therethrough; and at least one ram assembly, comprising:

a ram shuttle slidably positionable in the ram channel between a retracted and extended position, the ram shuttle having a wedge cavity extending therethrough and an inclined surface thereon;

a ram wedge having a tubular cavity therethrough for receiving the tubular, the ram wedge slidably positionable in the wedge cavity between a retracted and an extended position, the ram wedge having a corresponding inclined surface engageable with the inclined surface of the ram shuttle to wedge between the ram shuttle and the housing of the blowout preventer whereby a force is generated therebetween, the ram wedge engageable with the tubular; and a ram seat positionable in the housing about the passage, the ram seat having a hole therethrough for receiving the tubular, the ram seat engageable with the ram wedge and the housing of the blowout preventer when the ram shuttle and the ram wedge are moved to the extended position whereby a seal is formed therebetween; and positioning a tubular through the passage, the tubular cavity and the hole; and forming a seal between the ram seat and the ram wedge by moving the ram shuttle and the ram wedge to the extended position.

18. The method of claim 17, wherein the forming comprises moving the ram wedge and the ram shuttle together.

19. The method of claim 17, wherein the forming comprises moving the ram wedge to a partially engaged position and then moving the ram wedge to fully engaged position by moving the ram shuttle to the engaged position.

20. The method of claim 17, wherein the forming comprises forming a fluid barrier between the channel and fluid in the wellbore.

21. The method of claim 17, wherein the forming comprises generating a force by wedging the ram wedge between the ram shuttle and the housing.

* * * * *